US007592983B2

(12) United States Patent
Ozawa et al.

(10) Patent No.: US 7,592,983 B2
(45) Date of Patent: Sep. 22, 2009

(54) ELECTRO-OPTICAL DEVICE, METHOD OF DRIVING ELECTRO-OPTICAL DEVICE, PIXEL CIRCUIT, AND ELECTRONIC APPARATUS

(75) Inventors: Tokuro Ozawa, Suwa (JP); Ryoichi Nozawa, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 643 days.

(21) Appl. No.: 11/243,427

(22) Filed: Oct. 5, 2005

(65) Prior Publication Data

US 2006/0092148 A1 May 4, 2006

(30) Foreign Application Priority Data

Oct. 26, 2004 (JP) ..... 2004-310433
Jun. 30, 2005 (JP) ..... 2005-191122

(51) Int. Cl.
*G09G 3/30* (2006.01)
*G09G 5/00* (2006.01)
*G09G 3/10* (2006.01)

(52) U.S. Cl. ..... 345/76; 345/77; 345/211; 315/169.3

(58) Field of Classification Search ..... 345/76–83, 345/44–46, 92, 211–215; 315/169.1–169.3
See application file for complete search history.

(56) References Cited

U.S. PATENT DOCUMENTS 5,952,789 A * 9/1999 Stewart et al. ..... 315/169.4
6,476,419 B1 * 11/2002 Yasuda ..... 257/72
(Continued)

FOREIGN PATENT DOCUMENTS

JP A 08-054836 2/1996
(Continued)

*Primary Examiner*—Sumati Lefkowitz
*Assistant Examiner*—Seokyun Moon
(74) *Attorney, Agent, or Firm*—Oliff & Berridge, PLC

(57) ABSTRACT

An electro-optical device includes a plurality of pixel circuits that are disposed to correspond to intersections of a plurality of scanning lines and a plurality of data lines, a scanning line driving circuit that sequentially selects the plurality of scanning lines to apply a selection voltage to the selected scanning line, a data line driving circuit that applies any one of an on voltage and an off voltage to the plurality of data lines in accordance with gray-scale levels of pixel circuits corresponding to intersections of the data lines and the selected scanning line by the scanning line driving circuit, and a signal supply circuit that supplies a driving signal, of which the level periodically changes, to a signal supply line. Each of the pixel circuits has a first transistor in which, when the on voltage is applied to a gate electrode, a first terminal is connected to a second terminal, an electro-optical element that is connected to the first terminal of the first transistor, a first capacitor one end of which is connected to the second terminal of the first transistor and simultaneously the other end of which is connected to the signal supply line, a second capacitor one end of which is connected to the gate electrode of the first transistor, and a second transistor in which, when the selection voltage is applied to a gate electrode connected to a corresponding scanning line, a first terminal connected to a corresponding data line is connected to a second terminal connected to one end of the second capacitor.

12 Claims, 14 Drawing Sheets

U.S. PATENT DOCUMENTS 6,710,548 B2 * 3/2004 Kimura ..... 315/169.3
6,768,480 B2 * 7/2004 Jinno ..... 345/80
6,919,886 B2 * 7/2005 Sato et al. ..... 345/205
7,139,008 B2 * 11/2006 Mori et al. ..... 345/690
2002/0167472 A1 * 11/2002 Jinno ..... 345/76
2005/0248514 A1 * 11/2005 Sato et al. ..... 345/76
2007/0126757 A1 * 6/2007 Itoh et al. ..... 345/690

FOREIGN PATENT DOCUMENTS

JP A 2002-366058 12/2002
WO WO 03025894 A2 * 3/2003

* cited by examiner

ELECTRO-OPTICAL DEVICE, METHOD OF DRIVING ELECTRO-OPTICAL DEVICE, PIXEL CIRCUIT, AND ELECTRONIC APPARATUS

INCORPORATED BY REFERENCE

This nonprovisional application claims the benefit of Japanese Patent Application No. 2004-310433, filed Oct. 26, 2004 and No. 2005-191122, filed Jun. 30, 2005. The entere disclosure of the prior applications are hereby incorporated by reference herein in its entirety.

BACKGROUND

The present invention relates to a technology which uses electro-optical elements.

Electro-optical elements, such as OLED (Organic Light Emitting Diode) elements or the like, emit light themselves when a current flows therein. The electro-optical elements are current-controlled light-emitting elements that are turned off when the supply of the current stops. Accordingly, in order to ensure sufficient luminance so as to maintain the light emission of such an electro-optical element, a structure for continuously supplying the current to an OLED element needs to be provided. In view of this situation, in the related art, a configuration in which a capacitor serving as a current supply source to the OLED element is provided for each pixel has been suggested. For example, in Japanese Unexamined Patent Application Publication No. 8-54836 (FIG. 11), a configuration has been disclosed in which an electric charge according to the gray-scale level of each electro-optical element is accumulated in a capacitor in a horizontal scanning period and, with the electric charge accumulated in the capacitor, a current is supplied to the electro-optical element after the horizontal scanning period lapses. On the other hand, in such a configuration, in order to cause the electro-optical element to continuously emit light over a predetermined length of time, sufficient electrostatic capacitance of the capacitor needs to be ensured. Then, in Japanese Unexamined Patent Application Publication No. 2002-366058, a configuration has been disclosed in which a plurality of electrodes and a plurality of dielectrics are laminated.

However, in the technology disclosed in Japanese Unexamined Patent Application Publication No. 2002-366058, in order to laminate the electrodes and the dielectrics of the capacitor, a photolithography process needs to be repeatedly performed several times, which results in a problem in that a manufacturing process is complicated, manufacturing costs are increased, and yield is degraded. In particular, when the pixel is reduced in size in order to realize a high-definition image, the capacitor must be reduced in size. Accordingly, the manufacturing costs or the yield cannot be maintained at a realistic level.

SUMMARY

An advantage of the invention is that it provides an electro-optical device which can ensure sufficient luminance of an electro-optical element without complicating the configuration of a pixel circuit.

According to a first aspect of the invention, an electro-optical device includes a plurality of pixel circuits that are disposed to correspond to intersections of a plurality of scanning lines and a plurality of data lines, a scanning line driving circuit that sequentially selects the plurality of scanning lines to apply a selection voltage to the selected scanning line, a data line driving circuit that applies any one of an on voltage and an off voltage to the plurality of data lines in accordance with gray-scale levels of pixel circuits corresponding to intersections of the data lines and the selected scanning line by the scanning line driving circuit, and a signal supply circuit that supplies a driving signal, whose level periodically changes, to signal supply lines. Each of the pixel circuits has a first transistor (for example, a transistor Tr1 of FIG. 1) in which, when the on voltage is applied to a gate electrode, a first terminal is connected to a second terminal, an electro-optical element that is connected to the first terminal of the first transistor, a first capacitor (for example, a capacitor C1 of FIG. 1) one end of which is connected to the second terminal of the first transistor and simultaneously the other end of which is connected to a corresponding signal supply line, a second capacitor (for example, a capacitor C2 of FIG. 1) one end of which is connected to the gate electrode of the first transistor, and a second transistor (for example, a transistor Tr2 of FIG. 1) in which, when the selection voltage is applied to a gate electrode connected to a corresponding scanning line, a first terminal connected to a corresponding data line is connected to a second terminal connected to one end of the second capacitor.

In accordance with the first aspect of the invention, when the selection voltage is applied to the scanning line and then the second transistor is turned on, a voltage applied to the data line at that time is held in the second capacitor. If the on voltage is held in the second capacitor and then the first transistor is turned on, one end of the first capacitor is connected to the electro-optical element via the first transistor. At this time, current flows in the electro-optical element with a timing at which the level of the driving signal to be supplied to the other end of the first capacitor changes. Therefore, after the application of the selection voltage to the scanning line stops and the second transistor is turned off, the electro-optical element continuously emits light. As a result, sufficient luminance can be maintained. Further, in this configuration, two transistors are sufficient for one pixel circuit. Besides, the first capacitor is sufficient to have electrostatic capacitance only for generating a current in accordance with the change in level of the driving signal. Unlike the related art, electrostatic capacitance for causing the electro-optical element to continuously emit light over a sufficient time length does not need to be ensured. Therefore, according to the first aspect of the invention, the configuration of the pixel circuit can be simplified, as compared with the related art, and thus a yield of an electro-optical device can be enhanced or manufacturing costs can be reduced.

The electro-optical device according to the invention is used as display devices of various electronic apparatuses and devices for exposing an object as a target to be processed in a photolithography technology. Moreover, the electro-optical elements of the invention are elements whose optical characteristics change due to electrical energy. As such elements, OLED elements, such as organic electroluminescent (EL) or light-emitting polymer, can be exemplified. However, the invention is not limited thereto.

In the invention, of course, an image having two gray-scale levels of a gray-scale level when the on voltage is applied to the data line and a gray-scale level when the off voltage is applied to the data line can be displayed, but multilevel gray-scale display can be performed, for example, by use of first and second modes described below. First, in the first mode, the scanning line driving circuit sequentially selects the plurality of scanning lines for respective subfields of one field having different time lengths from one another, and the data line driving circuit applies any one of the on voltage and the off voltage to the respective data lines for each subfield in accordance with the gray-scale levels of the pixel circuits. In this mode, the time length for which the voltage applied to the data line is held in the second capacitor (that is, the first transistor is turned on, and the electro-optical element is connected to the first capacitor) is different for each subfield. Therefore, when any one of the on voltage and the off voltage is applied to the data lines for each subfield in accordance with the gray-scale levels of the pixel circuits, multilevel gray-scale display can be performed. This mode will be described below as a first embodiment.

Further, in the second mode, the scanning line driving circuit sequentially the plurality of scanning lines for respective subfields included in one field, the data line driving circuit applies any one of the on voltage and the off voltage to the data lines for each subfield in accordance with the gray-scale levels of the pixel circuits, and the signal supply circuit supplies the driving signal, whose waveform changes for each subfield, to the corresponding signal supply line. In this mode, the waveform of the driving signal to be supplied to the corresponding signal supply line changes for each subfield, and thus, when the first transistor is turned on, a current flowing from the first capacitor to the electro-optical element via the first transistor also changes for each subfield. Therefore, when any one of the on voltage and the off voltage to the data lines for each subfield in accordance with the gray-scale levels of the pixel circuits, multilevel gray-scale display can be performed. This mode will be described below as a second embodiment.

Moreover, in this mode, like the first mode, a configuration in which the time lengths of the subfields included in one field are different from one another is adopted. According to this configuration, when the waveform of the driving signal differs for each subfield and the on voltage is held in the second capacitor for each subfield, luminance of the electro-optical element can be controlled. As a result, multilevel gray-scale display can be performed. Further, in the second mode, the time lengths of the respective subfields may be the same.

Further, in the second mode, the driving signal may be a signal whose level changes for each subfield or a signal whose frequency changes for each subfield. For example, when the time lengths of the respective subfields are the same, in the subfield in which the driving signal is the high level, luminance of the electro-optical element is enhanced. Further, as the frequency of the driving signal is increased, luminance of the electro-optical element is enhanced.

In the electro-optical device according to a specified mode of the first aspect of the invention, at least when the electro-optical element is reverse-biased, a path for connecting one end of the first capacitor and the corresponding signal supply line may be formed. According to this mode, ununiformity generated when the electro-optical element is forward-biased and reverse-biased can be solved. Therefore, the electro-optical element can be stably operated in accordance with the driving signal. Moreover, this mode will be described below as a third embodiment. For example, the path may be formed when a transistor interposed between one end of the first capacitor and the corresponding signal supply line is turned on (for example, see FIG. 14). In addition, the path may be formed by a resistive element that is interposed between one end of the first capacitor and the corresponding signal supply line.

Further, in the electro-optical device according to another mode of the first aspect of the invention, it is preferable that the electro-optical element be an element which has a gray-scale level according to a current flowing from an anode to a cathode at the time of being forward biased. Further, at least when the electro-optical element is reverse-biased, a path for connecting the anode and the cathode of the electro-optical element may be formed. According to this mode, ununiformity generated when the electro-optical element is forward-biased and reverse-biased can be solved. Therefore, the electro-optical element can be stably operated in accordance with the driving signal. Moreover, this mode will be described below as the third embodiment. For example, the path may be formed when a transistor interposed between the anode and the cathode of the electro-optical element is turned on. According to this configuration, since current flows in the path only when the transistor is turned on, power consumption can be reduced as compared with the case in which current flows in the path even when the transistor is turned off. Further, the path may be formed by a diode that is connected in parallel to the electro-optical element so as to be inverted to the electro-optical element (for example, see FIG. 16). In addition, the path may be formed by a resistive element that is interposed between the anode and the cathode of the electro-optical element (for example, see FIG. 18).

The invention can be specified as a pixel circuit. According to a second aspect of the invention, there is provided a pixel circuit that is disposed to correspond to an intersection of a scanning line and a data line and has a gray-scale level according to an on voltage or an off voltage applied to the data line when a selection voltage is applied to the scanning line. The pixel circuit includes a first transistor in which, when the on voltage is applied to a gate electrode, a first terminal is connected to a second terminal, an electro-optical element that is connected to the first terminal of the first transistor, a first capacitor one end of which is connected to the second terminal of the first transistor and simultaneously the other end of which is connected to a signal supply line, a second capacitor one end of which is connected to the gate electrode of the first transistor, and a second transistor in which, when the selection voltage is applied to a gate electrode connected to the scanning line, a first terminal connected to the data line is connected to a second terminal connected to one end of the second capacitor. According to this configuration, like the electro-optical device according to the first aspect of the invention, sufficient luminance of the electro-optical element can be ensured by use of a simple configuration.

Further, the invention can be specified as a method of driving an electro-optical device. According to a third aspect of the invention, there is provided method of driving an electro-optical device having a plurality of pixel circuits that are disposed to correspond to intersections of a plurality of scanning lines and a plurality of data lines, each of the pixel circuits having a first transistor in which, when an on voltage is applied to a gate electrode, a first terminal is connected to a second terminal, an electro-optical element that is connected to the first terminal of the first transistor, a signal supply line to which a driving signal whose level periodically changes is supplied, a first capacitor one end of which is connected to the second terminal of the first transistor and simultaneously the other end of which is connected to the signal supply line, a second capacitor one end of which is connected to the gate electrode of the first transistor, and a second transistor in which, when a selection voltage is applied to a gate electrode connected to a corresponding scanning line, a first terminal connected to a corresponding data line is connected to a second terminal connected to one end of the second capacitor. The method of driving an electro-optical device includes sequentially selecting the plurality of scanning lines to apply the selection voltage to the selected scanning line, applying any one of the on voltage and an off voltage to the plurality of data lines in accordance with gray-scale levels of pixel circuits corresponding to intersections of the data lines and the selected scanning line, and supplying a driving signal, whose level periodically changes, to the signal supply line. According to this configuration, like the electro-optical device according to the first aspect of the invention, sufficient luminance of the electro-optical device can be ensured, even when electrostatic capacitance of the first capacitor is small.

In the method of driving an electro-optical device according to a first mode of the third aspect of the invention, the plurality of scanning lines may be selected for respective subfields of one field having different time lengths from one another, and any one of the on voltage and the off voltage may be applied to the respective data lines for each subfield in accordance with the gray-scale levels of the pixel circuits. Further, as a second mode, the plurality of scanning lines may be selected for respective subfields included in one field, any one of the on voltage and the off voltage may be applied to the data lines for each subfield in accordance with the gray-scale levels of the pixel circuits, and the driving signal, whose waveform changes for each subfield, may be supplied to the signal supply line. According to the first and second modes, multilevel gray-scale display can be performed in accordance with the pixel circuits. In addition, the method of driving an electro-optical device according to the third aspect of the invention is applied to a case in which an image having two gray-scale levels of a gray-scale level when the on voltage is applied to the data line and a gray-scale level when the off voltage is applied to the data line is displayed.

BRIEF DESCRIPTION OF THE DRAWINGS

The invention will be described with reference to the accompanying drawings, wherein like numbers reference like elements, and wherein:

FIG. 3 is a circuit diagram showing an electrical configuration of a driving unit when a transistor is turned on;

DETAILED DESCRIPTION OF EMBODIMENTS

A: Configuration of Pixel Circuit

First, prior to the description of the electro-optical device according to the invention, the configuration of the pixel circuit to be used in the electro-optical device will be described.

Figure 1:
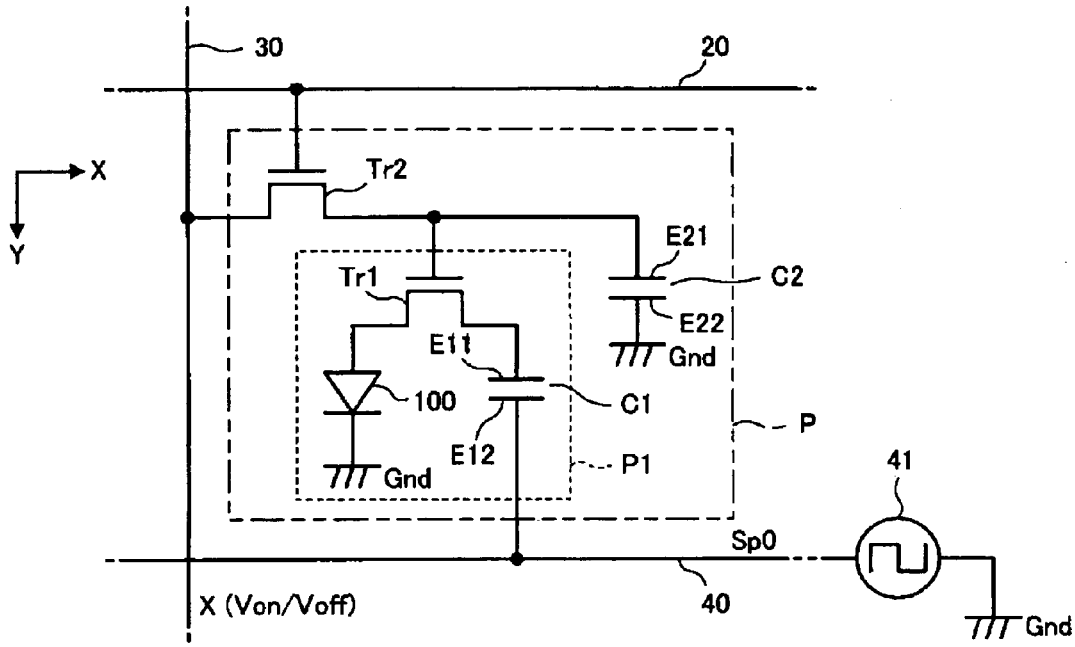
FIG. 1 is circuit diagram showing a configuration of a pixel circuit according to the invention.

FIG. 1 is a circuit diagram showing the configuration of one pixel circuit. As shown in FIG. 1, the pixel circuit P is disposed at an intersection of a scanning line 20 extending in an X direction and a data line 30 extending in a Y direction and has a driving unit P1, a transistor Tr2, and a storage capacitor C2. Of them, the driving unit P1 includes a transistor Tr1, a capacitor C1, and an electro-optical element 100. The transistors Tr1 and Tr2 are, for example, thin film transistors formed on a substrate, which are formed with the same material through the common process. In the present embodiment, the transistors Tr1 and Tr2 are n-channel transistors, but the conduction types thereof can be suitably changed. On the other hand, the electro-optical element 100 is a current-driven light-emitting element in which, when a forward voltage exceeds a threshold voltage Vth, a current Ie1 flows from an anode to a cathode and light is emitted with luminance proportional to the current Ie1. The electro-optical element 100 may be an OLED element, for example.

A gate electrode of the transistor Tr2 is connected to the scanning line 20 and a source electrode thereof is connected to the data line 30. One electrode E21 of the storage capacitor C2 is connected to a drain electrode of the transistor Tr2 and the other electrode E22 is grounded (Gnd). Further, the electrode E22 of the storage capacitor C2 may be connected to a wiring line, to which a constant potential is applied. That is, the electrode E22 of the storage capacitor C2 does not need to be grounded.

Figure 2:
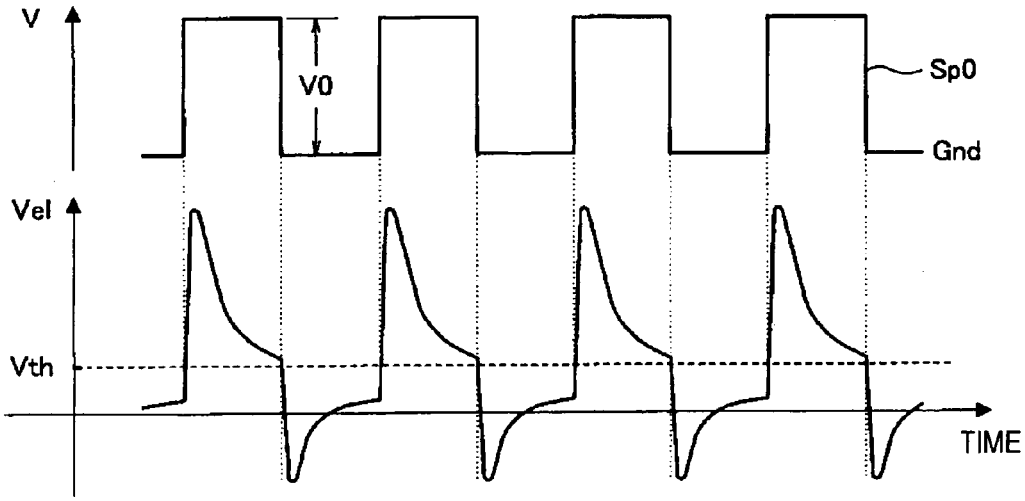
FIG. 2 is a timing chart showing the relationship between a waveform of a driving signal and a voltage applied to an electro-optical element.

On the other hand, a gate electrode of the transistor Tr1 constituting the driving unit P1 is connected to the electrode E21 of the storage capacitor C2 and the drain electrode of the transistor Tr2. The anode of the electro-optical element 100 is connected to a source electrode of the transistor Tr1 and a cathode thereof is grounded (Gnd). Further, one electrode E11 of the capacitor C1 is connected to a drain electrode of the transistor Tr1. Therefore, when the transistor Tr1 is turned on, the electro-optical element 100 is electrically connected to the capacitor C1. The other electrode E12 of the capacitor C1 is connected to a signal supply line 40. A voltage signal Sp0 (hereinafter, referred to as 'driving signal'), whose level periodically changes, is supplied to the signal supply line 40 from a signal supply circuit 41. As shown in FIG. 2, the driving signal Sp0 is a voltage signal whose level changes in an amplitude V0 with a ground potential Gnd as the L level.

In such a configuration, a voltage (hereinafter, referred to as 'selection voltage'), which turns on the transistor Tr2, is applied to the scanning line 20. Further, for a period (hereinafter, referred to as 'selection period') in which the selection voltage is applied to the scanning line 20, a data signal X is applied to the data line 30. The data signal X is any one of an on voltage Von and an off voltage Voff in accordance with a gray-scale level to be displayed by the pixel circuit P. The on voltage Von is a voltage which turns on the transistor Tr1 (that is, a voltage exceeding a threshold voltage of the transistor Tr1) and the off voltage Voff is a voltage which turns off the transistor Tr1 (that is, a voltage lower than the threshold voltage of the transistor Tr1).

When the selection voltage is applied to the gate electrode from the scanning line 20, the transistor Tr2 is turned on and the electrode E21 of the storage capacitor C2 is electrically connected to the data line 30. Therefore, the on voltage Von or the off voltage Voff, which is applied to the data line 30 in the selection period, is held by the storage capacitor C2 and maintained until a new data signal X is supplied in a next selection period. On the other hand, the transistor Tr1, the gate electrode of which is connected to the electrode E21, is turned on when the on voltage Von is held by the storage capacitor C2, and is turned off when the off voltage Voff is held by the storage capacitor C2. If the transistor Tr1 is turned on, the anode of the electro-optical element 100 is electrically connected to the electrode E11 of the capacitor C1. At this time, since the on voltage Von is held by the storage capacitor C2, the transistor Tr1 is maintained to be turned on, even when the application of the selection voltage to the scanning line 20 stops and the transistor Tr2 is turned off.

Figure 3:
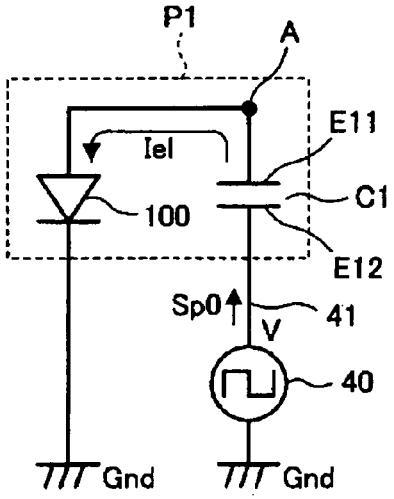

FIG. 3 is an equivalent circuit diagram showing the configuration of the driving unit P1 when the transistor Tr1 is turned on. The waveform of the voltage Ve1 at a point A (that is, the electrode E11 of the capacitor C1 and the anode of the electro-optical element 100) in FIG. 3 is shown at a lower side of FIG. 2. As shown in FIG. 2, the voltage Ve1 has a waveform corresponding to a differential waveform of the driving signal Sp0, which is supplied to the signal supply line 40. More specifically, with a timing at which the driving signal Sp0 changes from the ground potential Gnd to a voltage V0, the voltage Ve1 corresponding to the differential waveform (spike) of the driving signal Sp0 is generated at the electrode E11 of the capacitor C1. As shown in FIG. 2, the voltage Ve1 exceeds the threshold voltage Vth of the electro-optical element 100 just after the driving signal Sp0 rises until specified time lapses. On the other hand, with a timing at which the driving signal Sp0 falls from the voltage V0 to the ground potential Gnd, the voltage Ve1 corresponding to the differential waveform of the driving signal Sp0 is also generated.

When the voltage Ve1 exceeds the threshold voltage Vth of the electro-optical element 100 with the timing at which the driving signal Sp0 rises, the current Ie1 flows in the electro-optical element 100, and the electro-optical element 100 emits light with luminance proportional to the current Ie1. Since the level of the driving signal Sp0 periodically changes, in a period in which the on voltage Von is held by the storage capacitor C2 and the transistor Tr1 is maintained to be turned on, the current Ie1 is continuously supplied to the electro-optical element 100 with a timing in synchronization with the driving signal Sp0, such that the electro-optical element 100 continuously emits light. Therefore, even after the selection period lapses, the electro-optical element 100 emits light, and thus sufficient luminance can be ensured. As apparent from the description, the cycle of the driving signal Sp0 is preferably defined as a time length shorter than the period in which the on voltage Von is held by the storage capacitor C2 (that is, the time length after the application of the selection voltage to the scanning line 20 stops until a next selection voltage is applied). Moreover, when the off voltage Voff is held by the storage capacitor C2, the transistor Tr1 is maintained to be turned off. As a result, the electro-optical element 100 is electrically isolated from the capacitor C1. Therefore, the electro-optical element 100 does not emit light.

Further, in the configuration shown in FIG. 1, two transistors Tr1 and Tr2 are sufficient for one pixel circuit P. Besides, the capacitor C1 is sufficient to have electrostatic capacitance only for generating the current Ie1 in accordance with the change in level of the driving signal Sp0. Unlike the related art, electrostatic capacitance for causing the electro-optical element 100 to continuously emit light over a sufficient time length does not need to be ensured. Therefore, according to the present embodiment, the configuration of the pixel circuit P can be simplified, as compared with the configuration according to the related art in which a plurality of electrodes and dielectrics are laminated, and thus a yield of an electro-optical device can be enhanced or manufacturing costs can be reduced.

As described above, the electro-optical element 100 of the pixel circuit P switches light-emitting and non-light-emitting in accordance with the voltage applied to the data line 30. Therefore, according to the electro-optical device in which the pixel circuits P are arranged in a matrix shape, an image having two gray-scale levels of a gray-scale level when the electro-optical element 100 emits light and a gray-scale level when the electro-optical element 100 does not emit light can be displayed. In addition, according to respective embodiments described below, multilevel gray-scale display can be performed by use of the pixel circuits P. In these embodiments, one field (one frame) is divided into a plurality of subfields, and light-emitting and non-light-emitting of the electro-optical element 100 is controlled for each pixel circuit P in each subfield, multilevel gray-scale display can be realized.

B: First Embodiment

Figure 4:
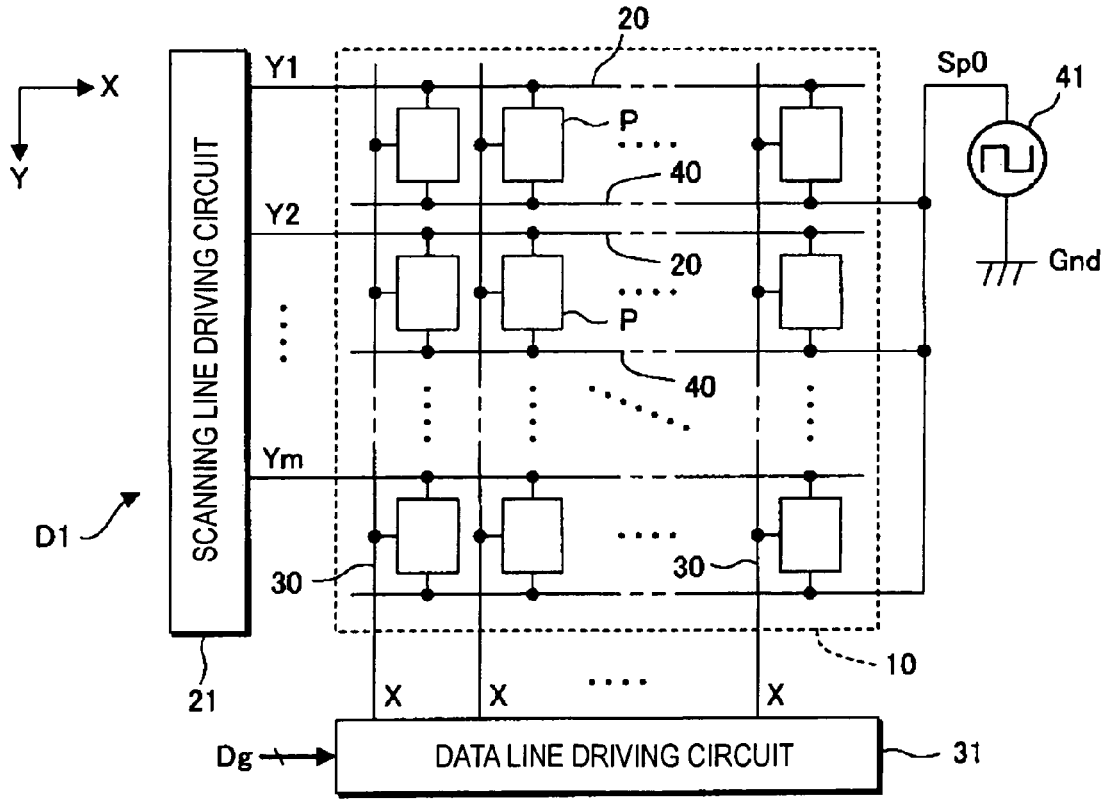
FIG. 4 is a block diagram showing a configuration of an electro-optical device according to a first embodiment of the invention.

FIG. 4 is a block diagram showing the configuration of an electro-optical device according to a first embodiment of the invention. As shown in FIG. 4, an electro-optical device D1 has an electro-optical panel 10 that display images, a scanning line driving circuit 21 and a data line driving circuit 31 that drive the electro-optical panel 10, and a signal supply circuit 41 that supplies a driving signal Sp0 to the electro-optical panel 10. The scanning line driving circuit 21, the data line driving circuit 31, or the signal supply circuit 41 may be mounted directly on the electro-optical panel 10 or may be mounted on a wiring board, which is bonded to the electro-optical panel 10.

The electro-optical panel 10 has m scanning lines 20 that extend in an X direction and are connected to the scanning line driving circuit 21, and n data lines 30 that extend in a Y direction perpendicular to the X direction and are connected to the data line driving circuit 31 (where, m and n are natural numbers). As shown in FIG. 1, since one pixel circuit P is disposed to correspond to the intersection of the scanning line 20 and the data line 30, the pixel circuits P are arranged in a matrix shape of m rows×n columns in the X and Y directions. As shown in FIG. 4, the electro-optical panel 10 has m signal supply lines 40 that extend in the X direction and are disposed in pairs with the m scanning lines 20. The capacitors C1 of n pixel circuits P belonging to an i-th row are commonly connected to an i-th signal supply line 40. In addition, these signal supply lines 40 are connected to one another and is connected to an output terminal of the signal supply circuit 41. Therefore, in the present embodiment, a common driving signal Sp0 is supplied to all the signal supply lines 40.

Figure 5:
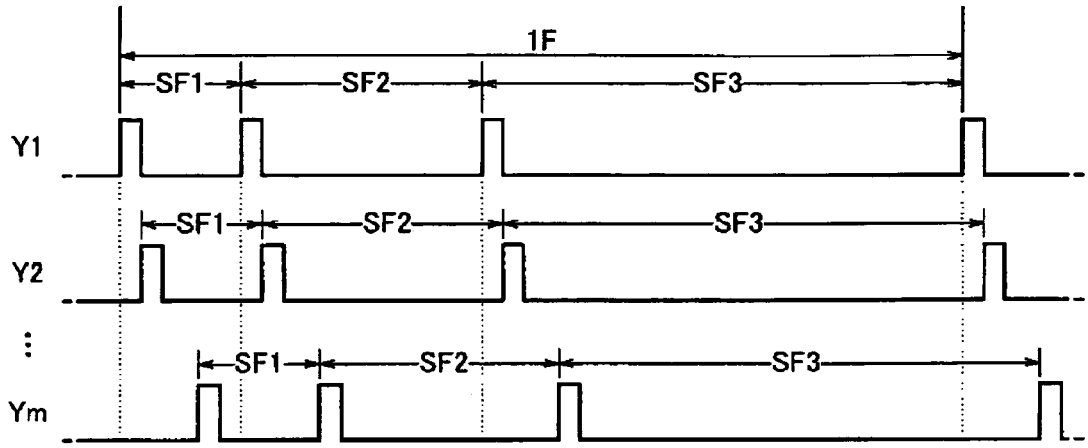
FIG. 5 is a timing chart showing waveforms of scanning signals.

The scanning line driving circuit 21 is a circuit that sequentially selects the m scanning lines 20 to apply the selection voltage to the selected scanning line 20. The scanning line driving circuit 21 has an m-bit shift register, for example. More specifically, as shown in FIG. 5, the scanning line driving circuit 21 outputs a scanning signal Yi to an i-th scanning line 20 as the selection voltage in the selection periods which start with the respective start points of the subfields SF1 to SF3 defined with respect to the i-th row. In the present embodiment, for convenience of explanation, it is assumed that the subfields SF1 to SF3 are defined individually for each row. That is, as shown in FIG. 5, it is assumed that the timing at which the scanning signal Yi transits to the selection voltage for the first time is defined as the start point of the subfield SF1 corresponding to the i-th row (that is, the start point of one field (1F)), and the timing at which the scanning signal Yi transits to the selection voltage next time is defined as the start point of the subfield SF2. The subfields SF1 to SF3 have the time lengths corresponding to two to the power and these time lengths are different from one another. More specifically, the ratio of the time lengths of the subfields is SF1:SF2:SF3=1:2:4. Moreover, in the following description, when any one of the subfield SF1 to SF3 included in one field does not need to be specified, each subfield is simply referred to as 'subfield SF'.

On the other hand, the data line driving circuit 31 is a circuit that output the data signal X to the data lines 30 on the basis of gray-scale data Dg inputted from an external apparatus. Gray-scale data Dg is digital data for defining a gray-scale level (luminance) of the electro-optical element 100 for each pixel circuit P. More specifically, any one of eight gray-scale levels is defined by three bits. The data signal X, which is supplied to one pixel circuit P, has a voltage corresponding to the least significant bit of gray-scale data Dg in the selection period of the subfield SF1, has a voltage corresponding to the second bit of gray-scale data Dg in the selection period of the subfield SF2, and has a voltage corresponding to the most significant bit of gray-scale data Dg in the selection period of the subfield SF3. The voltage of the data signal X supplied to each of the pixel circuits P is held by the storage capacitor C2 until a new data signal X is outputted in the selection period of a next subfield SF (that is, to the end point of each of the subfields SF1 to SF3), even when the selection period in which the pixel circuit P is selected lapses.

Figure 6:
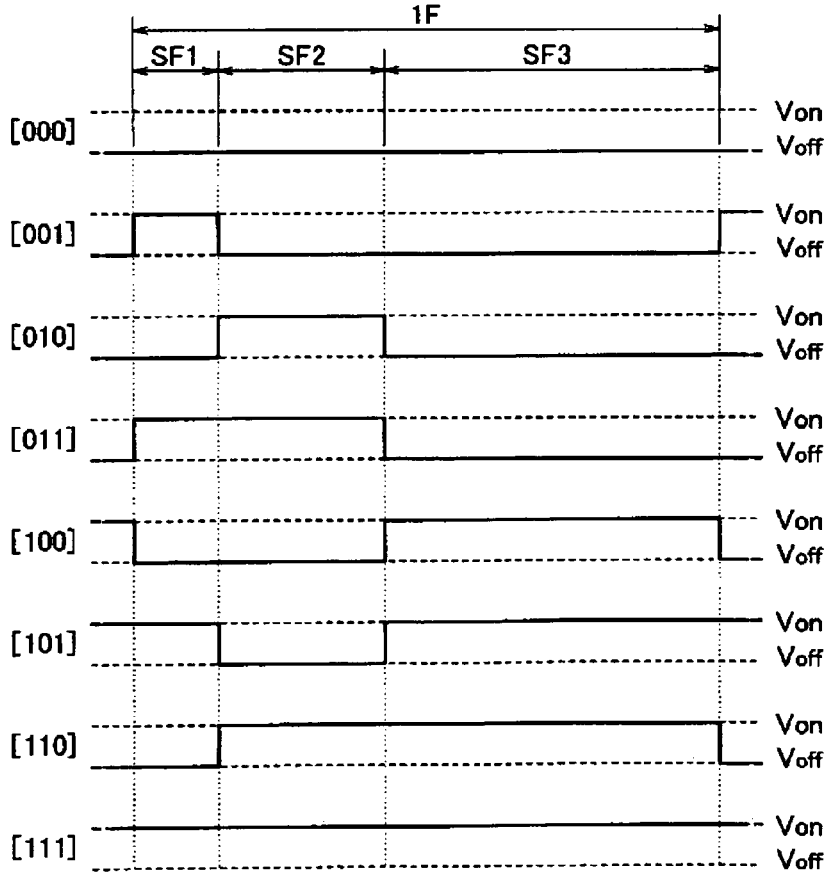
FIG. 6 is a timing chart showing a voltage held in a storage capacitor for each gray-scale level.

FIG. 6 is a timing chart showing the relationship between the voltage of the data signal X held by the storage capacitor C2 of each of the pixel circuits P and the subfields SF1 to SF3 for each gray-scale level. As shown in FIG. 6, any one of the on voltage Von and the off voltage Voff is held by the storage capacitor C2 in accordance with the bit corresponding to each subfield SF of gray-scale data Dg from the start point of each subfield SF to the end point thereof. For example, when gray-scale data Dg of any one of the pixel circuits P is [101], it is assumed that the on voltage Von corresponding to the least significant bit "1" is held in the subfield SF1 by the storage capacitor C2 of that pixel circuit P. Further, it is assumed that, in the subfield SF2, the off voltage Voff corresponding to the second bit "0" is held by the storage capacitor C2, and, in the subfield SF3, the on voltage Von corresponding to the most significant bit "1" is held by the storage capacitor C2. Therefore, the on voltage Von is held by the storage capacitor C2 of each of the pixel circuits P over the time length according to gray-scale data Dg of one field.

Figure 7:
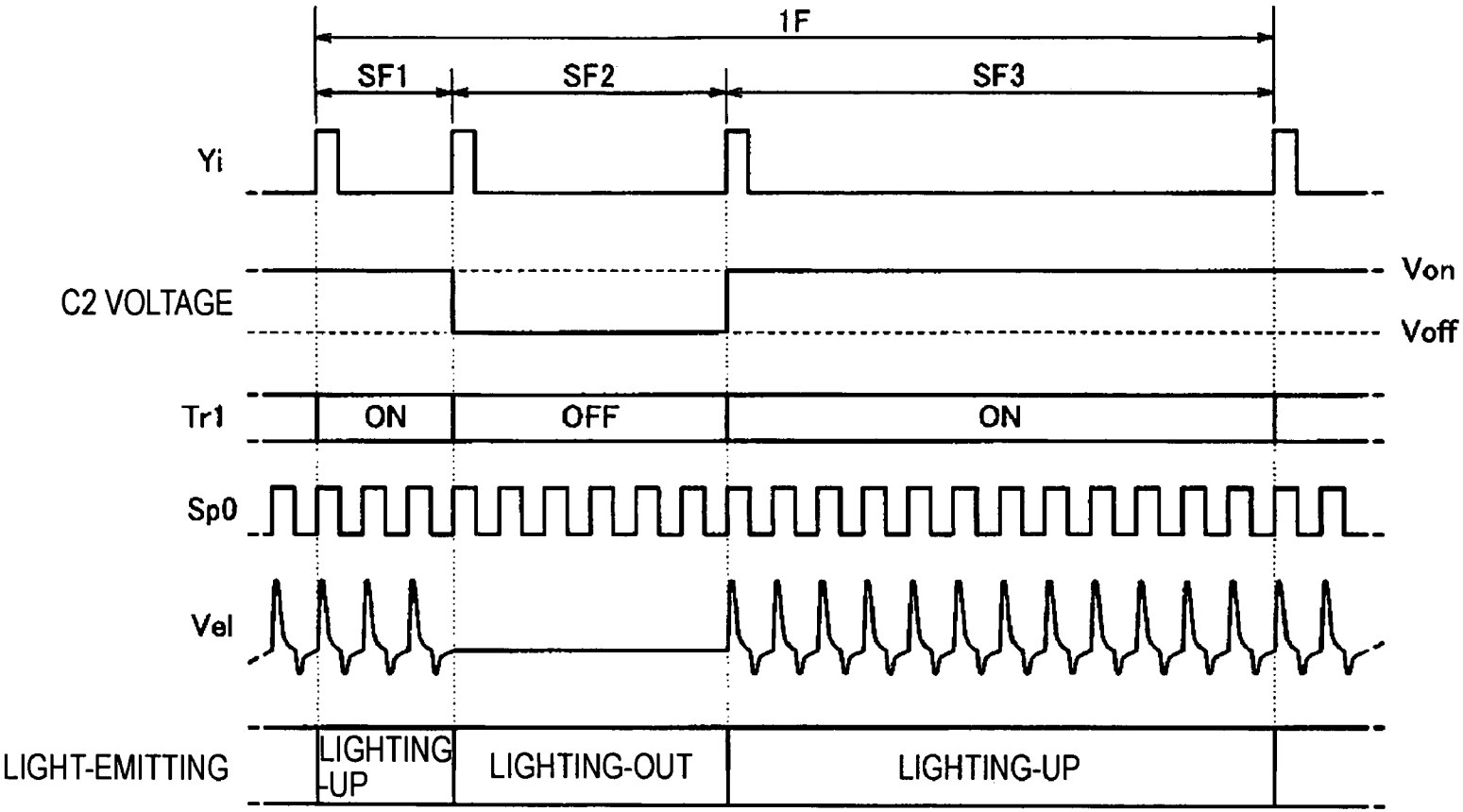
FIG. 7 is a timing chart illustrating an operation of the electro-optical device.

Next, the operation of the electro-optical device D1 according to the present embodiment will be described. FIG. 7 is a timing chart showing waveforms of respective signals relating to one pixel circuit P belonging to the i-th row. Here, it is assumed that gray-scale data Dg for assigning the gray-scale levels of the pixel circuits P is [101].

As shown in FIG. 7, the scanning signal Yi is maintained as the selection voltage in the selection period of each subfield SF and is maintained as the ground potential Gnd in other periods. On the other hand, the data signal X, which is supplied to the pixel circuits P, becomes the on voltage Von in the selection periods of the subfields SF1 and SF3 and becomes the off voltage Voff in the selection period of the subfield SF2. The on voltage and the off voltage are held by the storage capacitor C2 until the end point of each subfield SF comes. Therefore, as shown in FIG. 7, the transistor Tr1 of the pixel circuit P is turned on from the start point of each of the subfields SF1 and SF3 to the end point thereof and is turned off from the start point of the subfield SF2 to the end point.

On the other hand, the driving signal Sp0, which periodically changes regardless of the subfield SF, is supplied to the electrode E12 of the capacitor C1 constituting the pixel circuit P. The current Ie1 caused by the change in level of the driving signal Sp0 flows in the electro-optical element 100 from the capacitor C1 via the transistor Tr1 only in the subfields SF1 and SF3 in which the transistor Tr1 is maintained to be turned on. However, in the subfield SF2 in which the transistor Tr1 is turned on, the current Ie1 is not supplied to the electro-optical element 100. Therefore, as shown in FIG. 7, the electro-optical element 100 emits light in accordance with the current Ie1 only in the respective subfields SF1 and SF3 and does not emit light in the subfield SF2. As described above, since the time lengths of the respective subfields SF are different from one another, the total of the periods, in which the electro-optical element 100 emits light, of one field becomes the time length according to -gray-scale data Dg. Therefore, the electro-optical element 100 performs gray-scale display according to gray-scale data Dg.

As such, in the present embodiment, of the plurality of subfields SF1 to SF3, in the subfield SF selected in accordance with gray-scale data Dg, light-emitting is continuously performed in accordance with the driving signal Sp0. Therefore, even when electrostatic capacitance of the capacitor C1 is small, multilevel gray-scale display can be performed with high luminance.

C: Second Embodiment

In the first embodiment, the configuration in which the time lengths of the respective subfields SF1 to SF3 are different from one another so as to realize gray-scale display is exemplified. On the contrary, in the present embodiment, the time lengths of the respective subfields SF1 to SF3 are made to be equal to one another and the waveform of the driving signal changes for each subfield SF such that the current Ie1 flowing in the electro-optical element 100 is different for each subfield SF. Moreover, in the present embodiment, the same parts as those in the first embodiment are represented by the same reference numerals and the descriptions thereof will be omitted.

Figure 8:
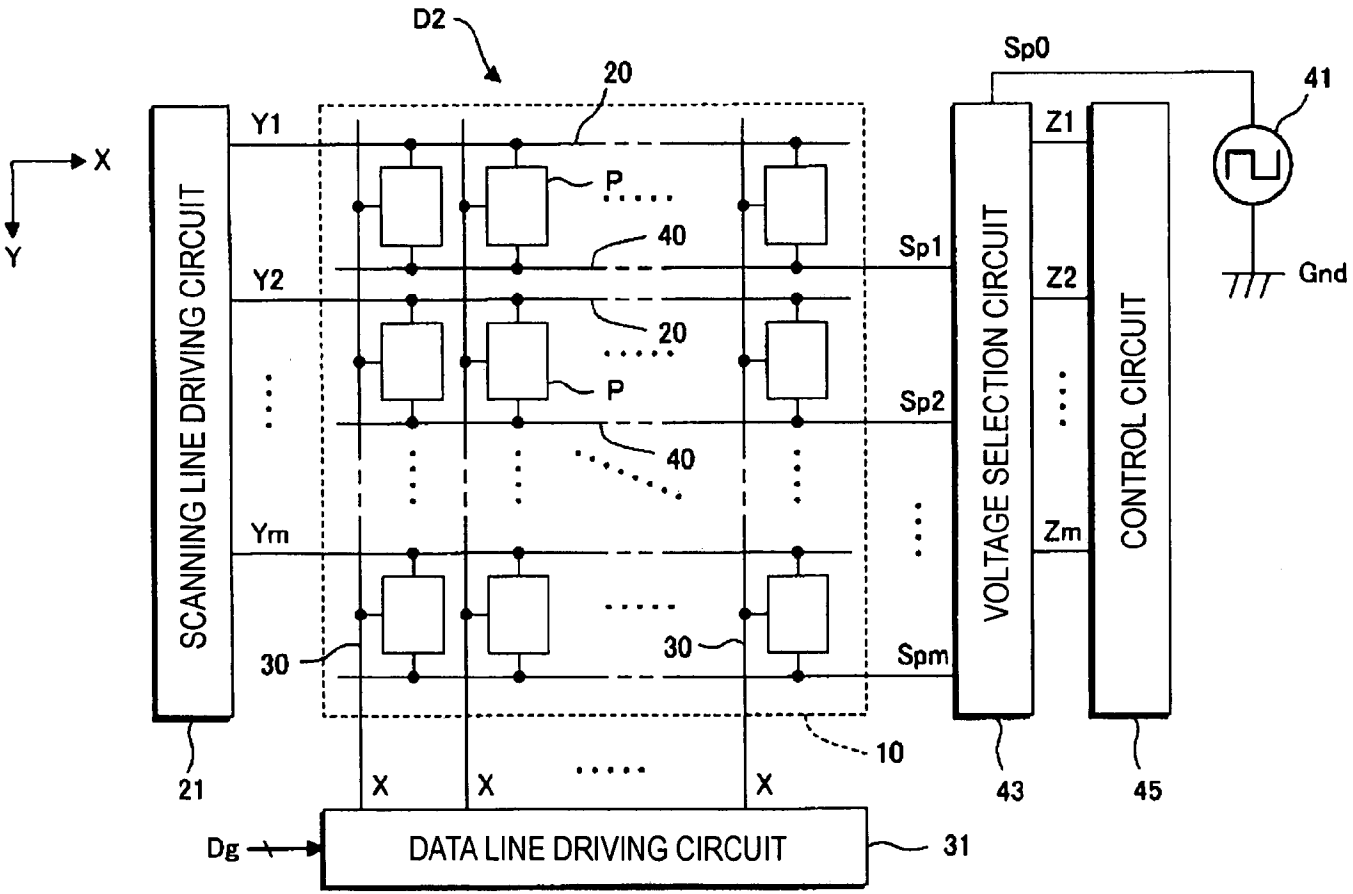
FIG. 8 is a block diagram showing a configuration of an electro-optical device according to a second embodiment of the invention.

FIG. 8 is a block diagram showing the configuration of an electro-optical device according to the present embodiment. As shown in FIG. 8, an electro-optical device D2 has a voltage selection circuit 43 and a control circuit 45, in addition to the same signal supply circuit 41 as that in the first embodiment.

Of them, the control circuit 45 has a m-bit shift register, like the scanning line driving circuit 21, and outputs control signals Z1, Z2, . . . , Zm, which sequentially become active for each selection period of each subfield SF. On the other hand, the voltage selection circuit 43 output driving signals Sp1, Sp2, . . . , Spm to the respective signal supply lines 40 based on the driving signal Sp0 outputted from the signal supply circuit 41.

Figure 9:
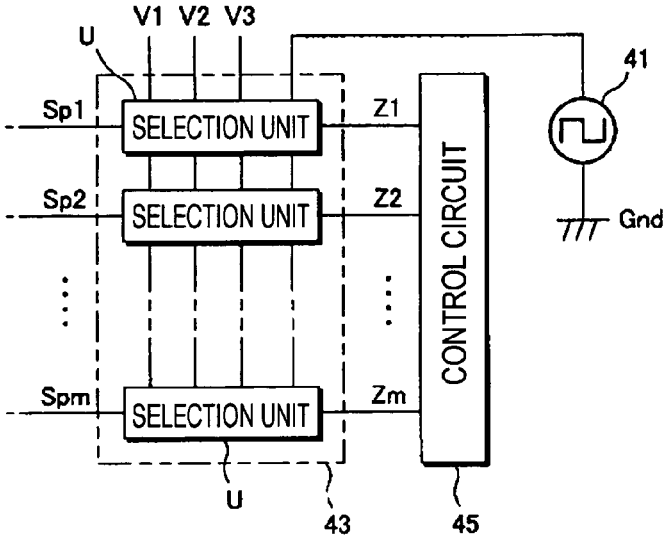
FIG. 9 is a block diagram showing a configuration of a voltage selection circuit.
Figure 10:
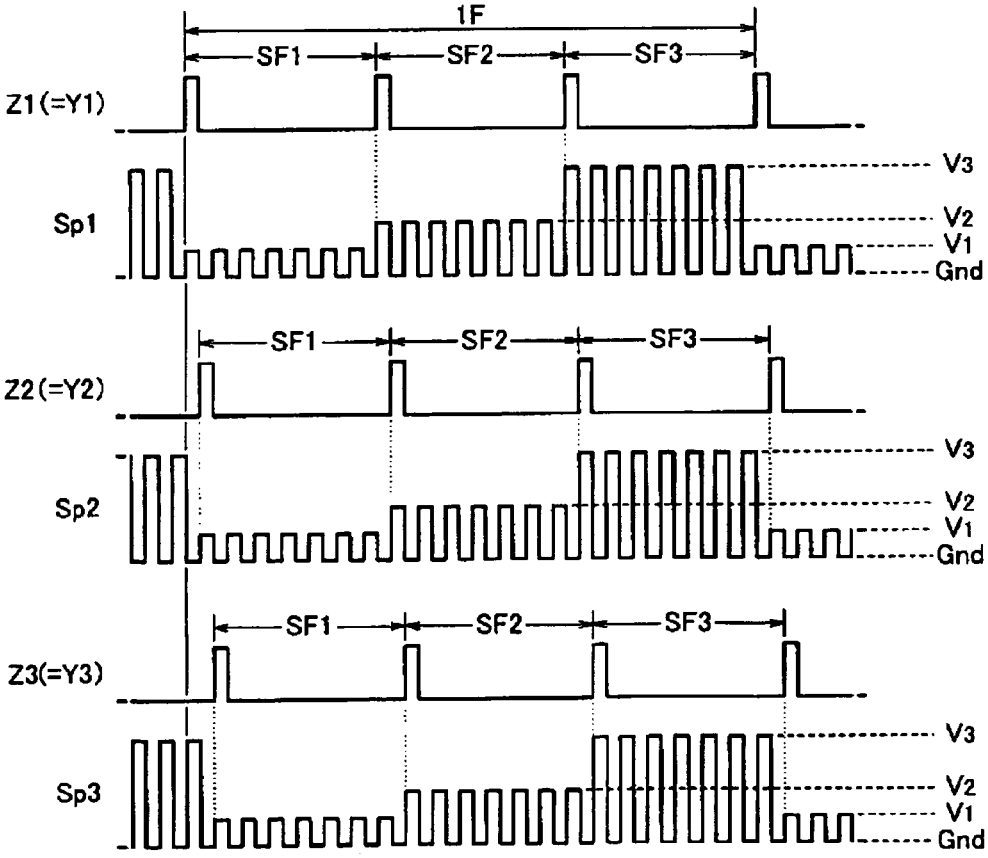
FIG. 10 is a timing chart showing waveform of driving signals which are supplied to respective signal supply lines.

FIG. 9 is a block diagram showing the specified configuration of the voltage selection circuit 43. As shown in FIG. 9, the voltage selection circuit 43 has m selection units U corresponding to the total number of rows. The selection unit U corresponding to each row is a unit that outputs the driving signal Sp0 with the amplitude according to the corresponding subfield SF in the respective subfields SF defined with respect to that row. Voltages V1 to V3 generated by a voltage generating circuit (power supply circuit) (not shown) and the driving signal Sp0 outputted from the signal supply circuit 41 are commonly supplied to all the selection units U. As shown in FIG. 10, the values of the voltages V1 to V3 are defined as two to the power with the ground potential Gnd as a reference. More specifically, the ratio of the values of the voltages V1 to V3 is V1:V2:V3=1:2:4.

The control signal Zi outputted from the control circuit 45 is supplied to the i-th selection unit U. The selection unit U selects a voltage corresponding to a subfield SF defined by the control signal Zi from the voltages V1 to V3, adjusts the amplitude of the driving signal Sp0 supplied from the signal supply circuit 41 to the selected voltage, and then outputs the adjusted voltage to the i-th signal supply line 40 as the driving signal Spi. Therefore, as shown in FIG. 10, the driving signal Spi periodically changes with the voltage amplitude V1 in the subfield SF1 defined with respect to the i-th row (that is, moves one of the ground potential Gnd and the voltage V1 to the other). Further, the driving signal Spi periodically changes with the voltage amplitude V2 in the subfield SF2 and periodically changes with the voltage amplitude V3 in the subfield SF3. Moreover, in the present embodiment, the cycle of the driving signal Spi is equal to that of the driving signal Sp0, regardless of the subfield SF.

Figure 11:
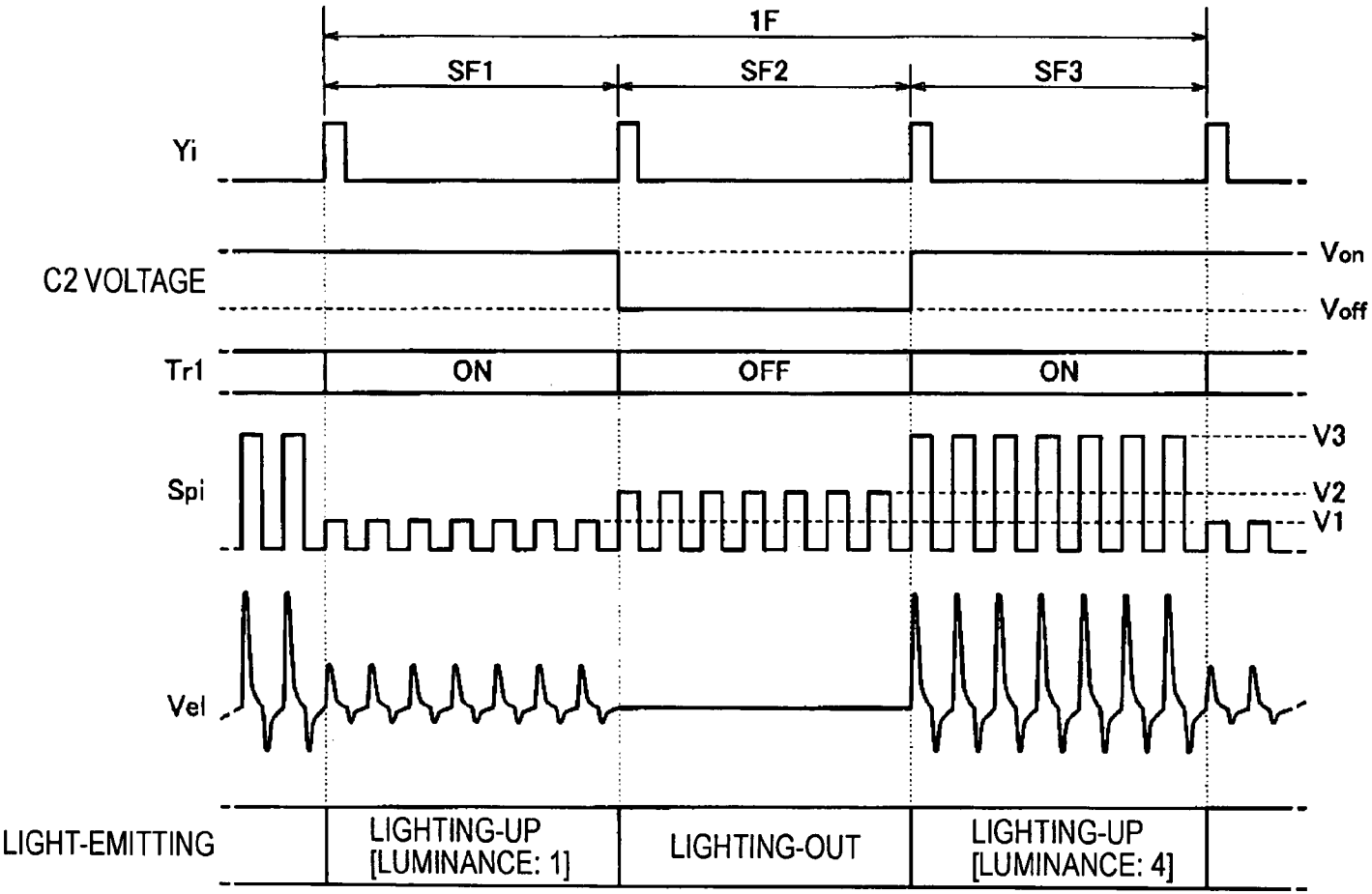
FIG. 11 is a timing chart illustrating an operation of the electro-optical device.

Next, the operation of the electro-optical device D2 according to the present embodiment will be described. FIG. 11 is a timing chart showing waveforms of respective signals relating to one of the i-th pixel circuits P. Here, like FIG. 7, it is assumed that gray-scale data Dg for defining the gray-scale level of the pixel circuit P is [101].

The operation in which the selection voltage is applied to each scanning line 20 and the transistor Tr1 of each pixel circuit P is turned on or turned off for each subfield SF is the same as that in the first embodiment, except that the time lengths of the subfields SF are equal to one another. Therefore, the transistor Tr1 of each of the i-th pixel circuits P is turned on in the subfields SF1 and SF3 and is turned off in the subfield SF2. Therefore, the current Ie1 generated when the driving signal Spi is supplied to the capacitor C1 is continuously supplied to the electro-optical element 100 from the start point of each of the subfields SF1 and SF3 to the end point thereof so as to cause the electro-optical element 100 to continuously emit light. On the other hand, in the subfield SF2, since the current is not supplied to the electro-optical element 100, the electro-optical element 100 does not emit light.

Here, the driving signal Spi changes with the amplitude V1 in the subfield SF1 and also changes with the amplitude V3, which is larger than the amplitude V1, in the subfield SF3. The current Ie1 caused by the change in voltage of the electrode E12 of the capacitor C1 is increased as the amount of the change is increased, and thus the current Ie1 flowing in the electro-optical element 100 in the subfield SF3 is larger than the current Ie1 flowing in the electro-optical element 100 in the subfield SF1. Then, since luminance of the electro-optical element 100 is proportional to the current flowing therein, luminance of the electro-optical element 100 in the subfield SF3 is larger than luminance in the subfield SF1. Therefore, the total amount of light emitted from the electro-optical element 100 in one field has a value according to gray-scale data Dg. As a result, the electro-optical element 100 can perform gray-scale display according to gray-scale data Dg.

As such, in the present embodiment, in the subfield SF selected according to gray-scale data Dg, the electro-optical element 100 periodically emits light in accordance with the driving signal Spi with the amplitude corresponding to that subfield SF. Therefore, even when electrostatic capacitance of the capacitor C1 is small, multilevel gray-scale display can be performed with high luminance.

D: Third Embodiment

FIG. 2 shows the example in which, when the transistor Tr1 is turned on, the voltage Ve1 of the anode of the electro-optical element 100 changes with a substantially constant potential as the amplitude center. On the other hand, there is a case in which the amplitude center of the voltage Ve1 sequentially changes according to characteristics of the electro-optical element 100. This will be described below in detail.

Figure 12:
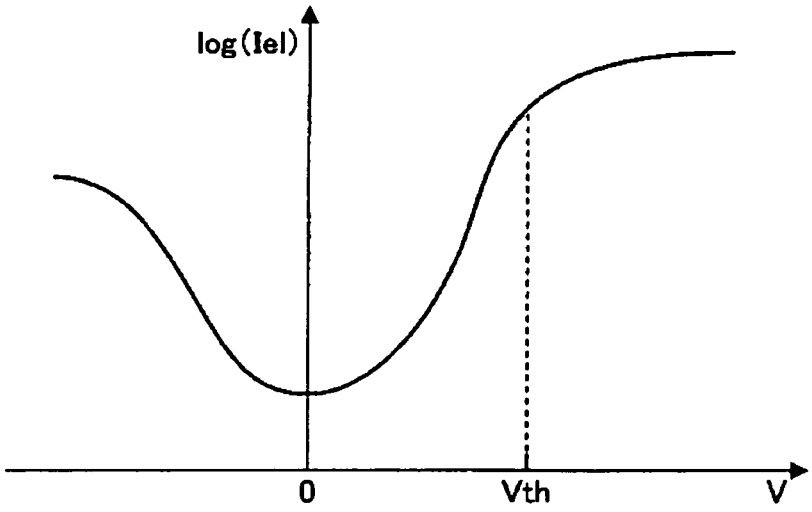
FIG. 12 is a graph showing characteristics of an electro-optical element according to a third embodiment of the invention.

It is assumed that an electro-optical element 100 having a voltage-current characteristic shown in FIG. 12 is adopted as the configuration shown in FIG. 1. As shown in FIG. 12, in the electro-optical element 100, the current Ie1 flows therein at the time of a forward bias, and also a leak current (off current) flows therein at the time of a reverse bias.

Figure 13:
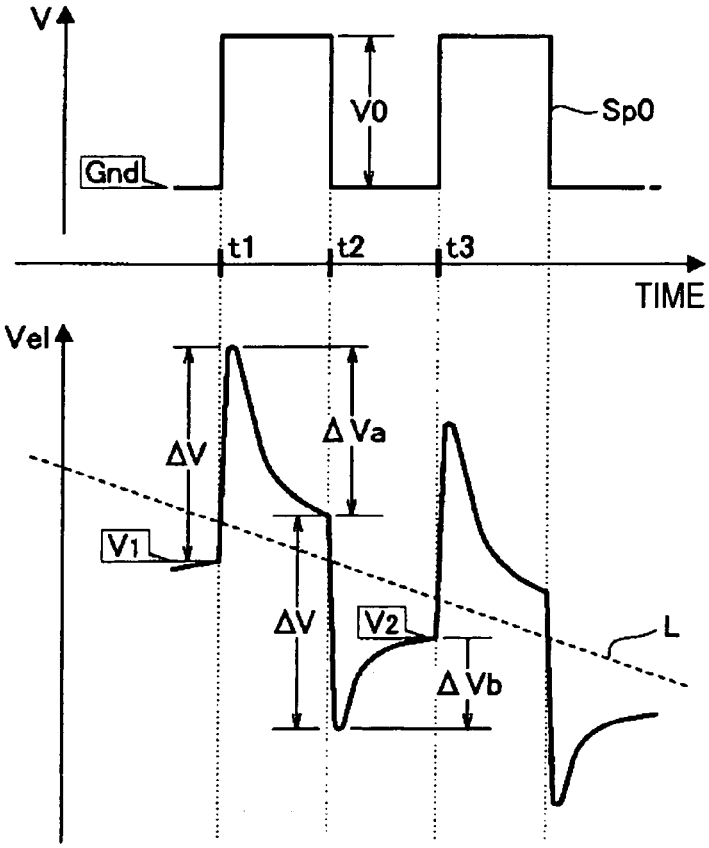
FIG. 13 is a timing chart illustrating a change in amplitude center of a voltage Ve1.

Next, FIG. 13 is a timing chart showing a state in which the amplitude center of the voltage Ve1 is sequentially lowered when the electro-optical element having the characteristics shown in FIG. 12 is used. As shown in FIG. 13, if the driving signal Sp0 supplied to the signal supply line 40 rises from the ground potential Gnd to the voltage V0 at the time t1, the voltage. Ve1 increase by ΔV from the value of the voltage V1 just before (the differential waveform of the driving signal Sp0) and an electric charge according to the increased voltage Ve1 is accumulated in the capacitor C1. At this time, the voltage Ve1 exceeds the threshold voltage Vth of the electro-optical element 100 (forward bias). Therefore, as shown in FIG. 12, when the electric charge of the capacitor C1 is discharged, the current Ie1 flows in the electro-optical element 100. With this discharge, the voltage Ve1 is lowered by the change amount ΔVa up to the time t2.

Next, at the time t2, if the driving signal Sp0 falls from the voltage V0 to the ground potential Gnd, the voltage Ve1 is lowered by ΔV (the same level as that just after the time t1). At this time, the voltage Ve1 is lower than the ground potential Gnd, and the electro-optical element 100 is reverse-biased. Therefore, as shown in FIG. 12, current leakage occurs in the electro-optical element 100. With leakage caused by the reverse bias, the voltage Ve1 is increased by ΔVb up to the time t3.

As shown in FIG. 12, the voltage-current characteristics of the electro-optical element 100 at the time of the forward bias and the reverse bias are asymmetric. More specifically, the current flowing in the electro-optical element 100 at the time of the reverse bias is smaller than the current flowing in the electro-optical element 100 at the time of the forward bias. That is, the time constant of an RC circuit having the capacitor C1 and the electro-optical element 100 at the time of the reverse bias is larger than that at the time of the forward bias. Therefore, the change amount ΔVb is smaller than the change amount ΔVa. As a result, the voltage Ve1 at the time t3 at which the driving signal Sp0 rises again has the value of the voltage V2 lower than the value of the voltage V1 at the time t1. As such, at the time at which the voltage Ve1 rises, the voltage Ve1 is sequentially lowered, and thus the amplitude center of the voltage Ve1 is sequentially deviated in a negative direction, as indicated by the dotted line in FIG. 13.

As described above, if the voltage Ve1 is lowered, the electro-optical element 100 is difficult to be controlled with high precision to have target luminance. Here, in the present embodiment, for example, as exemplified in first to third modes described below, the configurations are provided in which parts for solving unbalance of current leakage at the time of the forward bias and the reverse bias (that is, for ensuring the same current leakage at the time of the reverse bias and the forward bias) are disposed. Moreover, in the following description, the configurations based on the configuration shown in FIG. 1 have been exemplified, but the configuration of the present embodiment can be similarly adopted for other embodiments.

(1) First Mode

Figure 14:
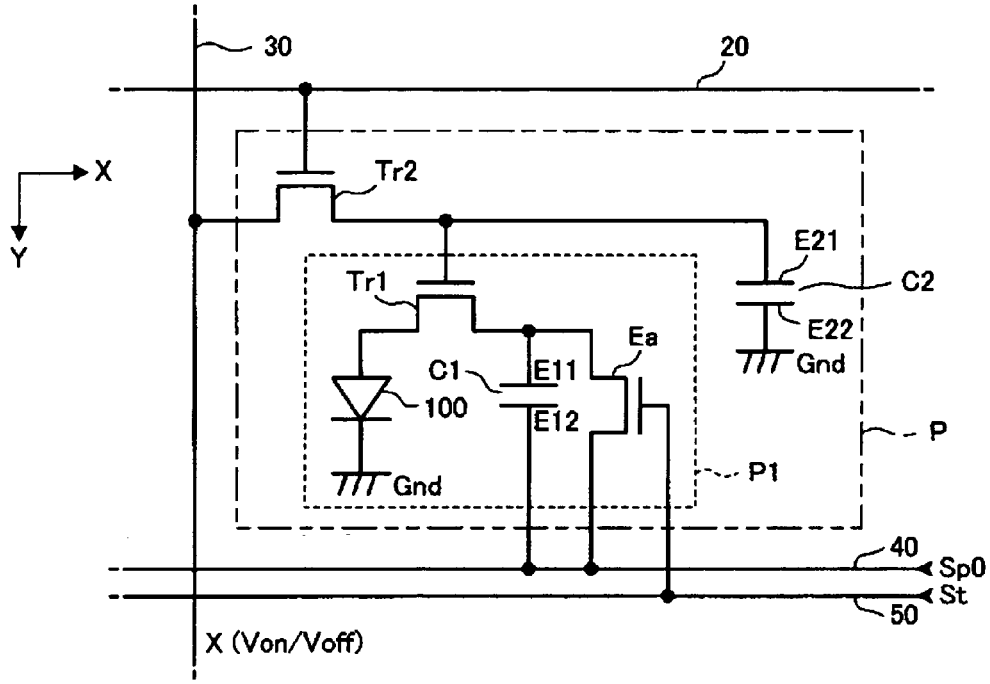
FIG. 14 is a circuit diagram showing a configuration of a pixel circuit according to a first mode.

FIG. 14 is a circuit diagram showing the configuration of a pixel circuit P according to the present mode. As shown in FIG. 14, a driving unit P1 of the pixel circuit P includes an n-channel transistor Ea, in addition to the respective parts of FIG. 1. The transistor Ea is interposed between the electrode E11 of the capacitor C1 and the current supply line 40 (or the electrode E12). A gate of the transistor Ea is connected to a signal supply line 50. A control signal St is supplied to the signal supply line 50 from a signal supply circuit (not shown). Moreover, the conduction type of the transistor Ea can be arbitrarily changed.

Figure 15:
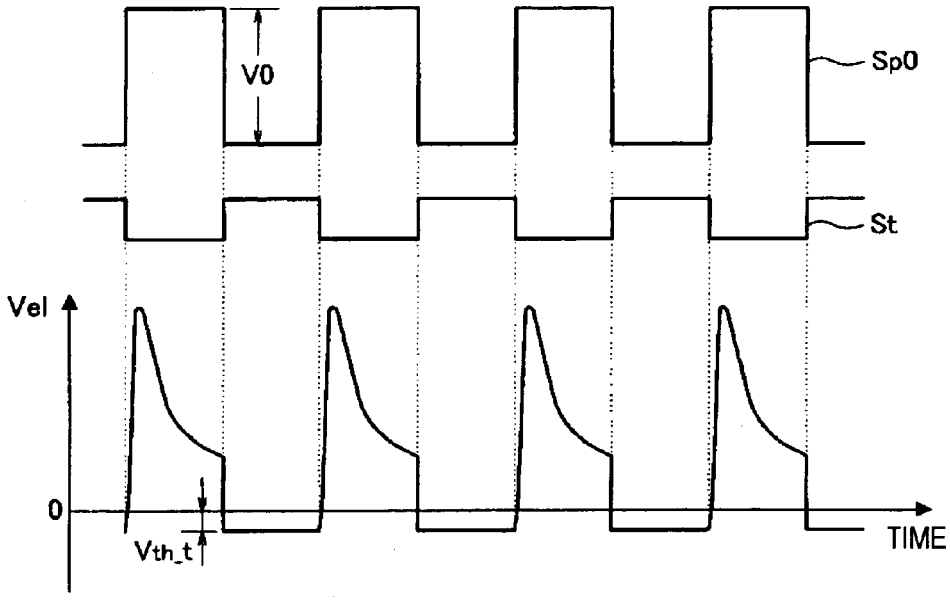
FIG. 15 is a timing chart illustrating an operation of the first mode.

FIG. 15 is a timing chart illustrating the operation of the present mode. As shown in FIG. 15, the control signal St changes in the same cycle as that of the driving signal Sp0, such that the control signal St becomes the low level (the level for turning off the transistor Ea) when the driving signal Sp0 is the voltage V0 and becomes the high level (the level for turning on the transistor Ea) when the driving signal Sp0 is the ground potential Gnd.

In such a configuration, when the driving signal Sp0 rises from the ground potential Gnd to the voltage V0, the transistor Ea is turned on with the low-level control signal St. Therefore, like the first embodiment, the voltage Ve1 exceeds the threshold voltage Vth of the electro-optical element 100, and the current Ie1 flows in the electro-optical element 100. On the other hand, when the driving signal Sp0 falls from the voltage V0 to the ground potential Gnd, the transistor Ea is turned off with the high-level control signal St. Therefore, in a period where the transistor Ea is maintained to be turned on, the voltage Ve1 is stabilized to a lower level by a threshold voltage Vth_t of the transistor Ea than the ground potential Gnd. As described above, according to the present mode, since the voltage Ve1 is maintained at a substantially constant level when the driving signal Sp0 is the ground potential Gnd, lowering of the amplitude center of the voltage Ve1 shown in FIG. 13 is effectively suppressed.

Moreover, though the configuration in which the transistor Ea is interposed between the electrode E11 of the capacitor C1 and the signal supply line 40 has been exemplified in this mode, but the transistor Ea may be interposed between the anode and the cathode of the electro-optical element 100 and the gate of the transistor Ea may be connected to the signal supply line 50. In this case, the same advantages as those in the present mode can be obtained.

(2) Second Mode

Figure 16:
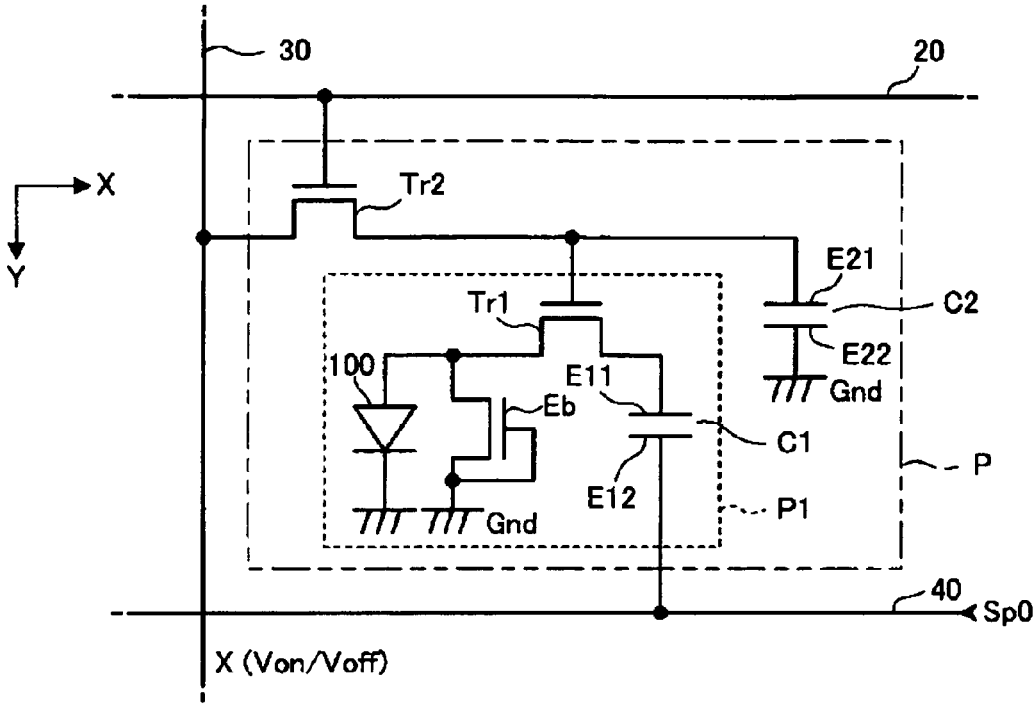
FIG. 16 is a circuit diagram showing a configuration of a pixel circuit according to a second mode.

FIG. 16 is a circuit diagram showing the configuration of a pixel circuit P according to the present mode. As shown in FIG. 16, a driving unit P1 of the pixel circuit P includes a diode Eb, in addition to the respective parts of FIG. 1. In the present mode, a transistor in which a gate and a source are connected to each other is used as the diode Eb. The diode Eb is disposed in parallel with the electro-optical element 100 so as to be inverted to the electro-optical element 100. That is, a cathode of the diode Eb is connected to the anode of the electro-optical element 100 and an anode of the diode Eb is connected to the cathode of the electro-optical element 100.

Figure 17:
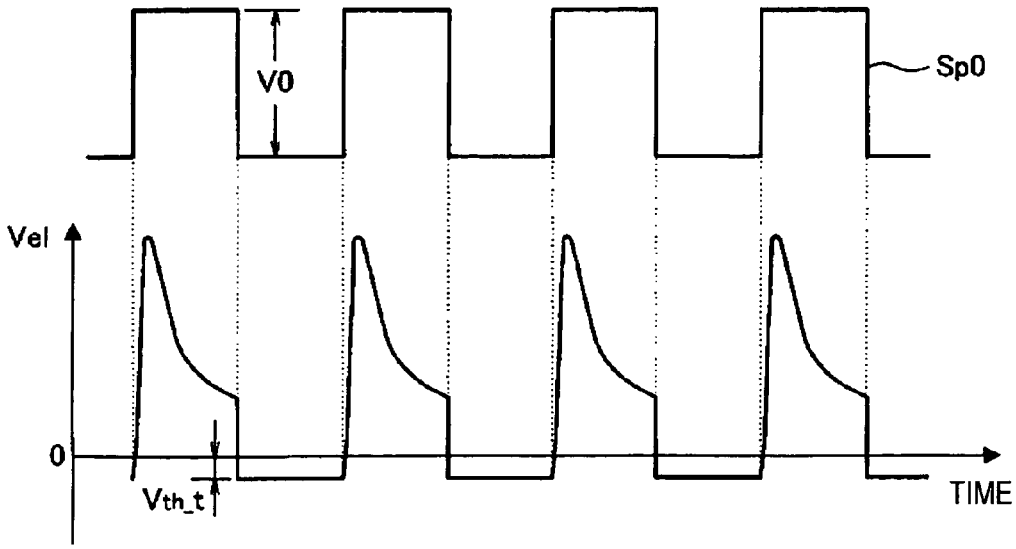
FIG. 17 is a timing chart illustrating an operation of the second mode.

In such a configuration, when the electro-optical element 100 is forward-biased, the diode Eb is reverse-biased. Therefore, like the first embodiment, the voltage Ve1 exceeds the threshold voltage Vth of the electro-optical element 100, and thus the current Ie1 flows in the electro-optical element 100. On the other hand, when the electro-optical element 100 is reverse-biased, the diode Eb is forward-biased. Therefore, as shown in FIG. 17, the voltage Ve1 at this time is maintained at a lower level by a threshold voltage of the diode Eb (more specifically, the threshold voltage of the transistor) Vth_t than the ground potential Gnd. However, the characteristics of the diode Eb are defined according to the characteristics of the electro-optical element 100 such that the current flowing in the electro-optical element 100 at the time of the forward bias is higher than the current flowing in the diode Eb at the time of the reverse bias, and the current flowing in the diode Eb at the time of the forward bias is higher than the current flowing in the electro-optical element 100 at the time of the reverse bias. In the present mode, the same advantages as those in the first mode can be obtained.

Moreover, FIG. 16 shows the case in which the diode Eb is constituted by the n-channel transistor, but the diode Eb may be constituted by a p-channel transistor. In this case, the gate of the transistor is connected to the anode of the electro-optical element 100. Further, instead of the diode Eb shown in FIG. 16, an OLED element having the same configuration as that of the electro-optical element 100 may be used. That is, the OLED element may be connected to be inverted to the electro-optical element 100. In such a configuration, if the size and characteristics of the OLED element are made common, the current (on current) at the time of the forward bias and the current (off current) at the time of the reverse bias are equal to each other. Therefore, the waveform distortion (ununiformity) of the voltage Ve1 can be reliably suppressed.

(3) Third Mode

Figure 18:
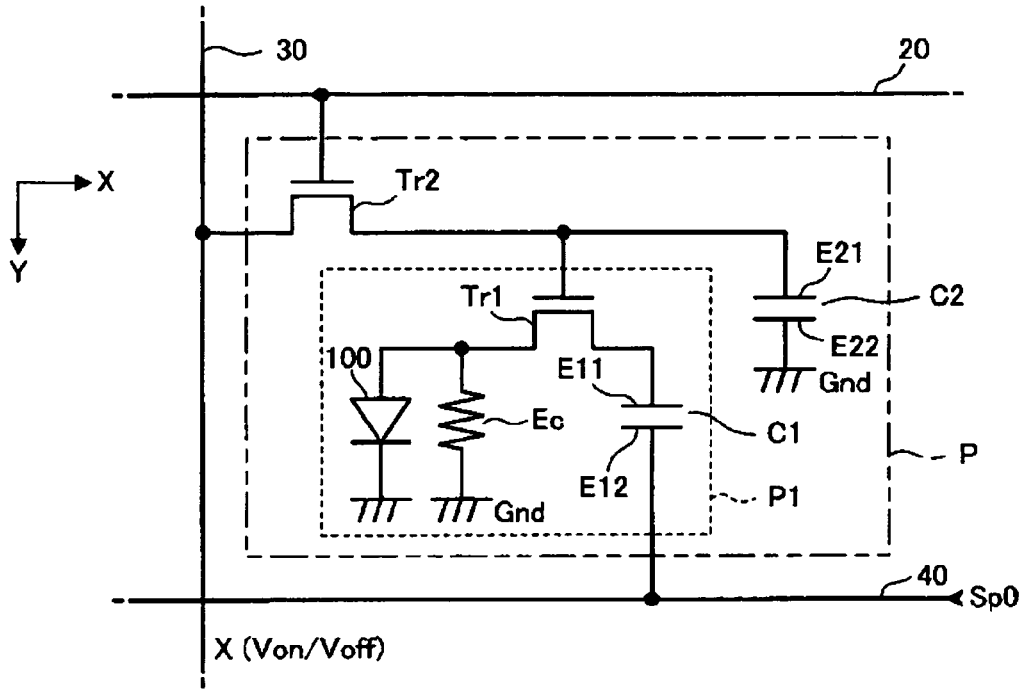
FIG. 18 is a circuit diagram showing a configuration of a pixel circuit according to a third mode.

FIG. 18 is a circuit diagram showing the configuration of a pixel circuit P according to the present mode. As shown in FIG. 18, a driving unit P1 of the pixel circuit P includes a resistive element Ec which is connected in parallel with the electro-optical element 100, in addition to the respective parts of FIG. 1. That is, one end of the resistive element Ec is connected to the anode of the electro-optical element 100 and the other end thereof is grounded. The resistance value Rx of the resistive element Ec is higher than the resistance value Ron (hereinafter, referred to as 'on resistance') of the electro-optical element 100 at the time of the forward bias exceeding the threshold voltage Vth and is lower than the resistance value Roff (hereinafter, referred to as 'off resistance') of the electro-optical element 100 at the time of the reverse bias (Ron<Rx<Roff). Moreover, the resistive element Ec may be interposed between the signal supply line 40 and the capacitor C1.

Like the present mode, when the resistive element Ec is disposed in parallel with the electro-optical element 100, the time constant of the driving unit P1 is lowered, as compared with the driving unit P1 in the configuration of FIG. 1. Therefore, in the present mode, the change amount of the voltage Ve1 (increased amount) from the start point to the end point of a section in which the driving signal Sp0 is maintained at the ground potential Gnd is increased, as compared with the configuration of FIG. 1. That is, at the time t3, the level V2 of the voltage Ve1 in the present mode is increased, as compared with the configuration of FIG. 1. As described above, according to the present mode, when the time constant of the driving unit P1 is lowered, the voltage Ve1 can be allowed to return to a higher level than the voltage Ve1 after the driving signal Sp0 has risen. Therefore, the amplitude center of the voltage Ve1 can be suppressed from being lowered.

More specifically, according to the present mode, the difference (that is, ununiformity of the waveform of the voltage Ve1) between the time constant of the driving unit P1 when the electro-optical element 100 is forward-biased and the time constant of the driving unit P1 when the electro-optical element 100 is reverse-biased can be lowered, as compared with the configuration of FIG. 1. This will be described below in detail.

The time constant of the driving unit P1 in the present mode is lowered, as compared with the configuration of FIG. 1, and this will be described below in detail. Now, paying attention to the driving unit P1 including the electro-optical element 100 and the capacitor C1 (the capacitance value C) in the configuration of FIG. 1 in which the resistive element is not disposed in parallel with the electro-optical element 100, the time constant at the time of the forward bias becomes C·Ron, and the time constant at the time of the reverse bias becomes C·Roff. Therefore, the difference value ΔT1 between the time constants at the time of the forward bias and the reverse bias in the configuration of FIG. 1 is represented by the following equation (1).

$$\Delta T1 = C(Ron - Roff) \quad (1)$$

Next, as shown in FIG. 18, considering that the configuration of the present mode in which the resistive element Ec is connected in parallel with the electro-optical element 100, the total resistance of the electro-optical element 100 and the resistive element Ec at the time of the forward bias becomes 'Ron·Rx/(Ron+Rx)'. Therefore, the time constant of the driving unit P1 at the time of the forward bias is represented by 'C·Ron·Rx/(Ron+Rx)'. On the other hand, the total resistance of the electro-optical element 100 and the resistive element Ec at the time of the reverse bias becomes 'Roff·Rx/(Roff+Rx)'. Therefore, the time constant at the time of the reverse bias is represented by 'C·Roff·Rx/ (Roff+Rx)'.

Therefore, in the present mode, the difference ΔT2 between the time constants at the time of the forward bias and the reverse bias is represented by the following equation (2).

$$\Delta T2 = C\{Ron \cdot Rx/(Ron+Rx) - Roff \cdot Rx/(Roff+Rx)\} \quad (2)$$

The equation (2) is modified to the following equation (3).

$$\Delta T2 = C \cdot Rx^2 \cdot (Ron - Roff)/\{(Ron+Rx)(Roff+Rx)\} \quad (3)$$

Here, when '$Rx^2/\{(Ron+Rx)(Roff+Rx)\}$' in the equation (3) is 'A', it can be seen from the equations (1) and (2) that ΔT1 and ΔT2 satisfy the following equation (4).

$$\Delta T2 = \Delta T1 \cdot A \quad (4)$$

On the other hand, when the numerator and the denominator of 'A' are divided by $Rx^2$, 'A' is modified to the following equation.

$$A = \{(Ron/Rx^2+1)(Roff/Rx^2+1)\}^{-1}$$

The denominator in this equation is larger than 1, and thus 'A' is larger than 1. From this equation and the equation (4), it can be seen that ΔT2 is smaller than ΔT1.

As described above, the difference ΔT2 between the time constant when the electro-optical element 100 is forward-biased and the time constant when the electro-optical element 100 is reverse-biased is smaller than the difference ΔT1 in the configuration of FIG. 1. This means that the difference between the change amount ΔVb and the change amount ΔVa shown in FIG. 13 is lowered, as compared with the configuration of FIG. 1. Therefore, as shown in FIG. 18, according to the configuration in which the resistive element Ec is disposed in parallel with the electro-optical element 100, the change of the voltage Ve1 caused by the difference in voltage-current characteristics at the time of the forward bias and the reverse bias can be suppressed.

E: Modifications

Various modifications to the respective embodiments can be made. Specified modification will be described below. Moreover, the appropriate combination of the respective modifications described below may be adopted.

(1) In the second embodiment, the configuration in which the voltage amplitude of the driving signal Spi changes for each subfield SF has been exemplified. However, the configuration for performing multilevel gray-scale display by use of the pixel circuit P shown in FIG. 1 is not limited thereto. Here, the voltage Ve1 for determining the current Ie1 may also change the frequency of the driving signal Spi, in addition to electrostatic capacitance of the capacitor C1 or the amplitude of the driving signal Spi. Therefore, as shown in FIG. 19, when the frequency of the driving signal Spi changes for each subfield SF, the configuration for performing multilevel gray-scale display can be realized.

Figure 19:
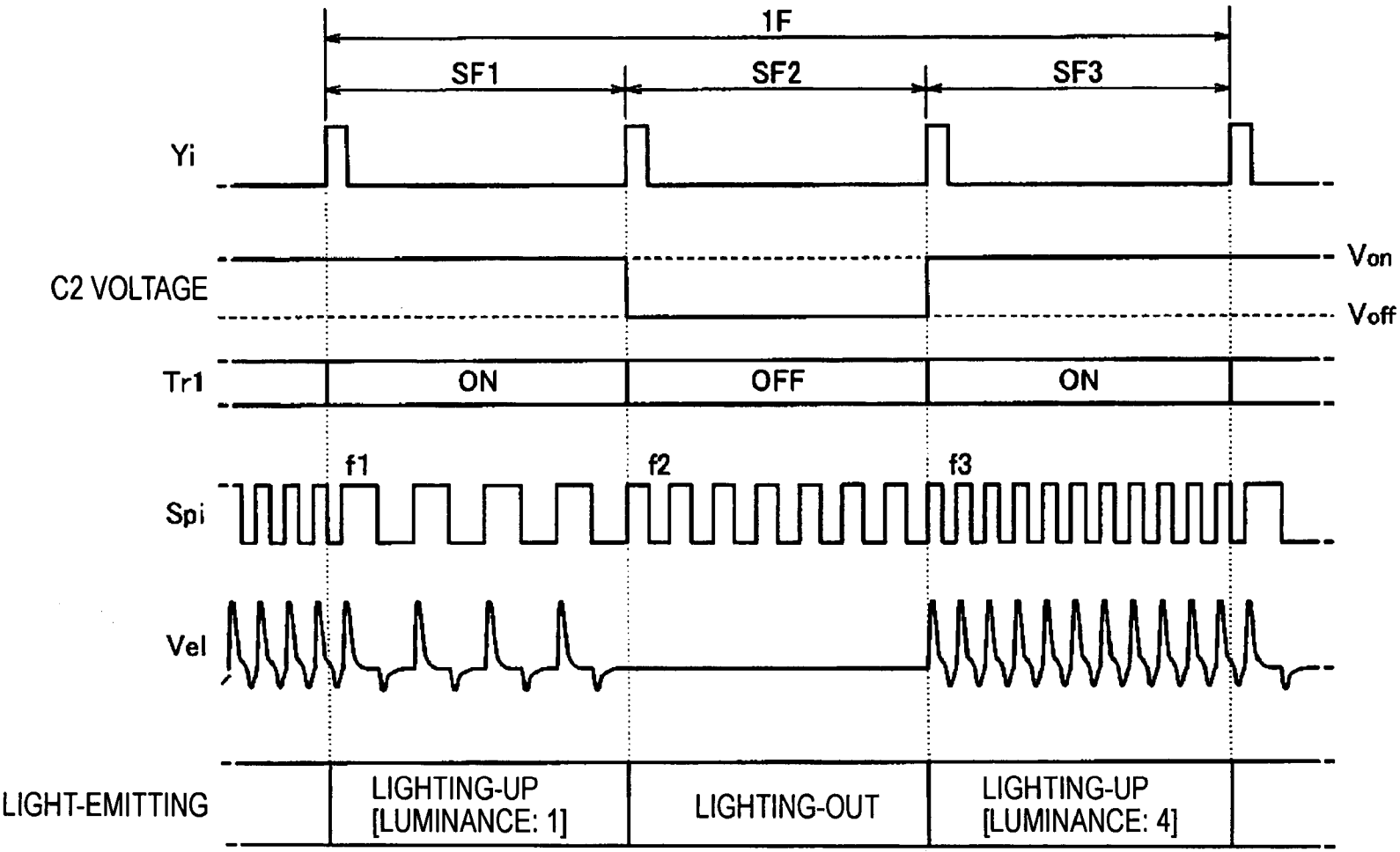
FIG. 19 is a timing chart showing an operation of a modification of the second embodiment.

In FIG. 19, the frequency of the driving signal Spi is determined for each subfield SF, such that the ratio of the frequency f1 of the driving signal Spi in the subfield. SF1, the frequency f2 of the driving signal Spi in the subfield SF2, and the frequency f3 of the driving signal Spi in the subfield SF3 is f1:f2:f3=1:2:4. In such a configuration, the size of the current Ie1 flowing whenever the driving signal Spi changes from the ground potential Gnd to the voltage V1 is substantially the same in all the subfields SF, but the number of times that the driving signal Spi changes is different for each subfield SF. Therefore, in one field, the total amount of light emitted from the electro-optical element 100 has a value according to gray-scale data Dg, such that the same advantages as those in the second embodiment can be obtained. As such, in the invention, the waveform of the driving signal Spi is sufficient to change for each subfield such that the current flowing in the electro-optical element 100 changes for each subfield.

(2) In the first embodiment, the configuration in which the time lengths of the respective subfields SF are different from one another so as to realize multilevel gray-scale display has been exemplified. Further, in the second embodiment, the configuration in which the waveform of the driving signal Spi changes for each subfield SF so as to realize multilevel gray-scale display has been exemplified. Alternatively, the combination of these configurations, for example, the configuration in which the waveform of the driving signal Spi changes for respective subfields SF having different time lengths may be used. According to this configuration, multilevel gray-scale display can be performed much more, as compared with the electro-optical devices D1 and D2 of the respective embodiments.

(3) The total number of subfields SF included in one field or the total number of gray-scale levels assigned by gray-scale data Dg may be arbitrarily changed. Further, in the respective embodiments, the configuration in which the driving signal Sp0 is a rectangular wave has been exemplified, but the waveform of the driving signal Sp0 can be properly changed. For example, the driving signal Sp0 of a triangular wave or a sine wave may be used. In summary, the driving signal Sp0 is sufficient to be a signal whose level thereof periodically changes (that is, a signal which generates the current Ie1 with the change in level). A specified mode will be passed over unnoticed.

(4) In the respective embodiments, the electro-optical device in which the OLED element is used as the electro-optical element 100 has been exemplified. However, the invention can be applied to other electro-optical elements. For example, the invention can be applied to various electro-optical devices, such as field emission displays (FEDs) or surface-conduction electron-emitter displays (SEDs), ballistic electron surface emitting displays (BSDs), display devices using light-emitting diodes, optical writing-type printers or writing heads of an electronic copying machines, or the like, like the above-described embodiments. As such, in the invention, the electro-optical element is an element which has a feature of converting one of electrical energy and optical energy to the other. The invention can be applied to all devices having such an electro-optical element.

F: Application

Figure 20:
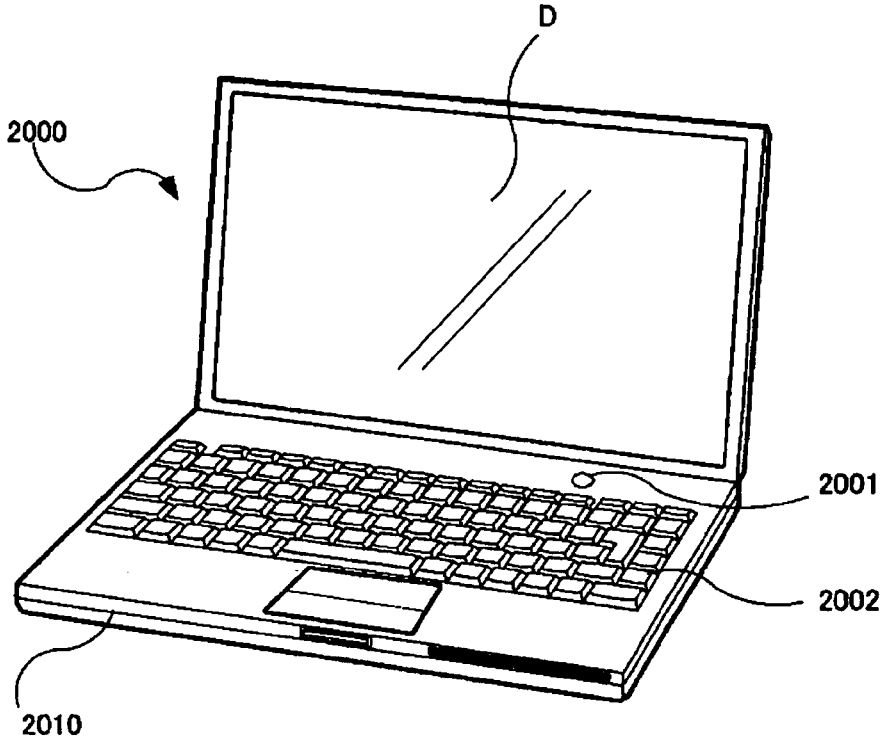
FIG. 20 is a perspective view showing a configuration of a personal computer to which the invention is applied.

Next, an electronic apparatus to which the electro-optical device according to the invention is applied will be described. FIG. 20 is a perspective view showing the configuration of a mobile personal computer in which the electro-optical device D (D1 or D2) according to each of the embodiments is used as a display device. A personal computer 2000 has the electro-optical device D as a display device and a main body 2010. In the main body 2010, a power switch 2001 and a keyboard 2002 are provided. The electro-optical device D uses the OLED elements 100, and thus a screen with a wide viewing angle and ease of seeing can be displayed.

Figure 21:
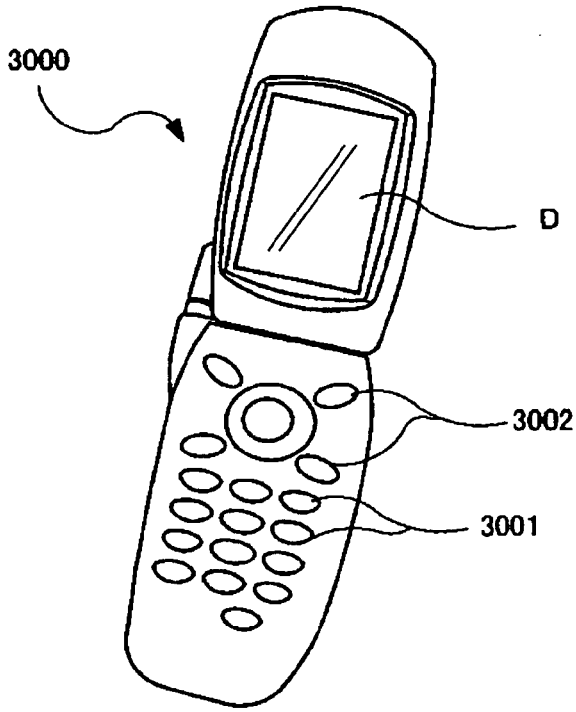
FIG. 21 is a perspective view showing a configuration of a cellular phone to which the invention is applied.

FIG. 21 shows the configuration of a cellular phone to which the electro-optical device D according to each of the embodiments is applied. A cellular phone 3000 has a plurality of operating buttons 3001, scroll buttons 3002, and the electro-optical device D as a display device. If the scroll buttons 3002 are operated, a screen displayed on the electro-optical device D is scrolled.

Figure 22:
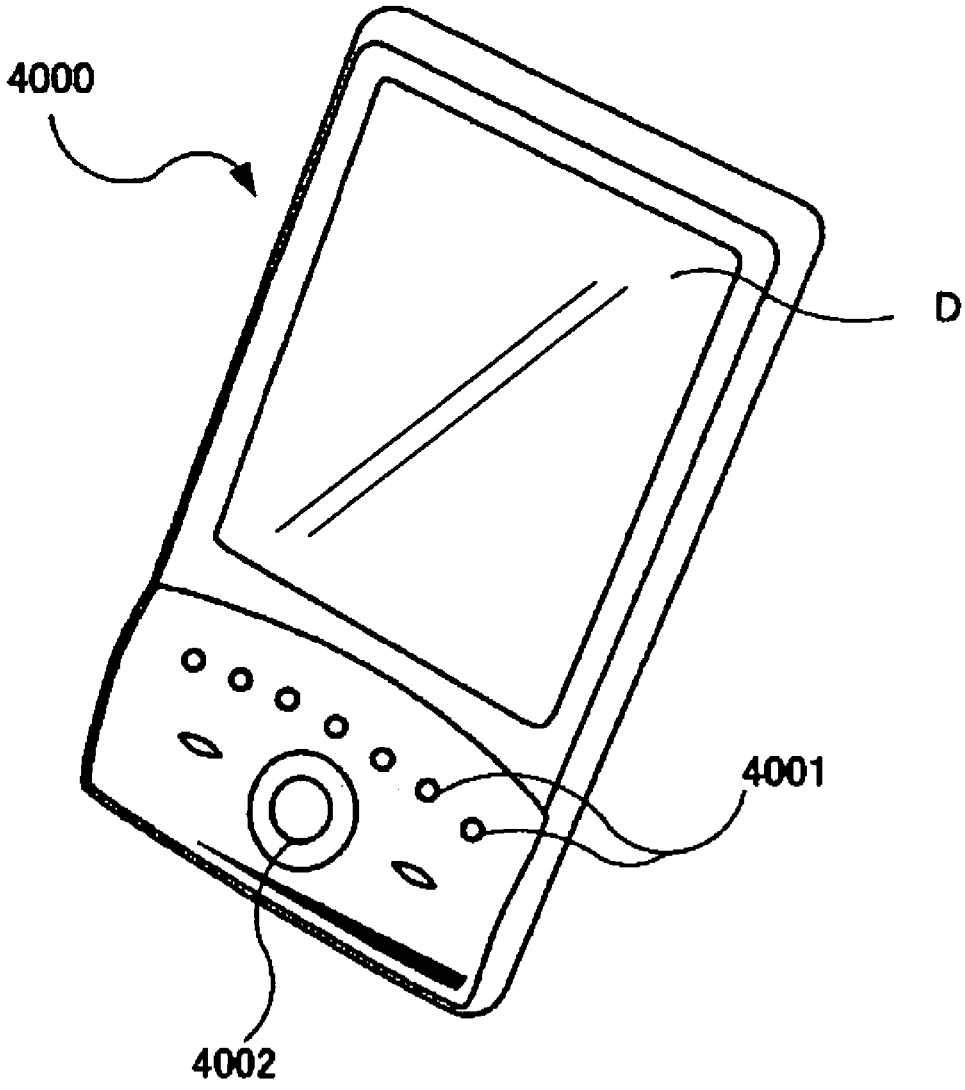
FIG. 22 is a perspective view showing a configuration of a portable information terminal to which the invention is applied.

FIG. 22 shows the configuration of a personal digital assistant (PDA) to which the electro-optical device D according to each of the embodiments is applied. A personal digital assistant 4000 has a plurality of operating buttons 4001, a power switch 4002, and the electro-optical device D as a display device. If the power switch 4002 is operated, various kinds of information, such as an address book or a scheduler, are displayed on the electro-optical device D.

Moreover, as an electronic apparatus to which the electro-optical device according to the invention is applied, in addition to those shown in FIGS. 20 to 22, a digital still camera, a television, a video camera, a car navigation device, a pager, an electronic organizer, an electronic calculator, a word processor, a workstation, a video phone, a POS terminal, a printer, a scanner, a copying machine, a video player, an apparatus having a touch panel, or the like can be exemplified.

What is claimed is:

1. An electro-optical device comprising:

a plurality of pixel circuits that are disposed to correspond to intersections of a plurality of scanning lines and a plurality of data lines;

a scanning line driving circuit that sequentially selects the plurality of scanning lines to apply a selection voltage to the selected scanning line;

a data line driving circuit that applies any one of an on voltage and an off voltage to the plurality of data lines in accordance with gray-scale levels of pixel circuits corresponding to intersections of the data lines and the selected scanning line by the scanning line driving circuit; and a signal supply circuit that supplies a driving signal, whose level periodically changes, to signal supply lines, wherein each of the pixel circuits has:

a first transistor including a gate electrode, a first terminal and a second terminal;

an electro-optical element that is disposed between the first terminal of the first transistor and ground;

a first capacitor dispose between the second terminal of the first transistor and a corresponding signal supply line;

a second capacitor disposed between the gate electrode of the first transistor and ground; and a second transistor including a gate electrode, a first terminal and a second terminal, the gate electrode connected to a corresponding scanning line, the first and second terminals of the second transistor disposed between a corresponding data line and the gate electrode of the first transistor, wherein the scanning line driving circuit respectively selects the plurality of scanning lines for respective subfields included in one field, the data line driving circuit applies any one of the on voltage and the off voltage to the data lines for each subfield in accordance with the gray-scale levels of the pixel circuits, the signal supply circuit supplies the driving signal, whose waveform changes for each subfield, to the corresponding signal supply line, wherein the signal supply circuit supplies the driving signal, whose frequency changes for each subfield, to the corresponding signal supply line.

2. The electro-optical device according to claim 1, wherein the scanning line driving circuit respectively selects the plurality of scanning lines for respective subfields of one field having different time lengths from one another, and the data line driving circuit applies any one of the on voltage and the off voltage to the respective data lines for each subfield in accordance with the gray-scale levels of the pixel circuits.

3. The electro-optical device according to claim 1, wherein the respective subfields included in one field have different time lengths from one another.

4. The electro-optical device according to claim 1, wherein the signal supply circuit supplies the driving signal, whose level changes for each subfield, to the corresponding signal supply line.

5. The electro-optical device according to claim 1, wherein, at least when the electro-optical element is reverse biased, a path for connecting one end of the first capacitor and the corresponding signal supply line is formed.

6. The electro-optical device according to claim 5, wherein the path is formed when a transistor interposed between one end of the first capacitor and the corresponding signal supply line is turned on.

7. The electro-optical device according to claim 5, wherein the path is formed by a resistive element that is interposed between one end of the first capacitor and the corresponding signal supply line.

8. The electro-optical device according to claim 1, wherein the electro-optical element is an element which has a gray-scale level according to a current flowing from an anode to a cathode at a time of being forward biased, and at least when the electro-optical element is reverse-biased, a path for connecting the anode and the cathode of the electro-optical element is formed.

9. The electro-optical device according to claim 8, wherein the path is formed when a transistor interposed between the anode and the cathode of the electro-optical element is turned on.

10. The electro-optical device according to claim 8, wherein the path is formed by a diode that is connected in parallel to the electro-optical element so as to be inverted to the electro-optical element.

11. The electro-optical device according to claim 8, wherein the path is formed by a resistive element that is interposed between the anode and the cathode of the electro-optical element.

12. An electronic apparatus comprising the electro-optical device according to claim 1.

* * * * *